US009975332B2

(12) United States Patent
Abe

(10) Patent No.: US 9,975,332 B2
(45) **Date of Patent: *May 22, 2018**

(54) LIQUID EJECTING APPARATUS, DRIVE CIRCUIT, AND HEAD UNIT

(71) Applicant: Seiko Epson Corporation, Tokyo (JP)

(72) Inventor: Akira Abe, Matsumoto (JP)

(73) Assignee: Seiko Epson Corporation (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/381,378

(22) Filed: Dec. 16, 2016

(65) Prior Publication Data

US 2017/0144434 A1 May 25, 2017

Related U.S. Application Data

(63) Continuation of application No. 15/007,612, filed on Jan. 27, 2016, now Pat. No. 9,555,625.

(30) Foreign Application Priority Data

Mar. 20, 2015 (JP) ..... 2015-058463

(51) Int. Cl.
*B41J 2/045* (2006.01)

(52) U.S. Cl.
CPC ..... *B41J 2/04541* (2013.01); *B41J 2/04581* (2013.01)

(58) Field of Classification Search
CPC ..... B41J 2/04541; B41J 2/04548; B41J 2/04581; B41J 2/0457
See application file for complete search history.

(56) References Cited

U.S. PATENT DOCUMENTS

| | | | | |
|---|---|---|---|---|
| 9,302,473 | B2 | 4/2016 | Otsuka et al. | |
| 9,555,625 | B2 * | 1/2017 | Abe | B41J 2/04541 |
| 2009/0206888 | A1 | 8/2009 | Kitazawa et al. | |
| 2011/0018919 | A1 | 1/2011 | Oshima et al. | |

FOREIGN PATENT DOCUMENTS

| | | | |
|---|---|---|---|
| JP | 2009-190287 | A | 8/2009 |
| JP | 2010-114711 | A | 5/2010 |

* cited by examiner

*Primary Examiner* — Jason Uhlenhake
(74) *Attorney, Agent, or Firm* — Harness, Dickey & Pierce, P.L.C.

(57) ABSTRACT

A drive circuit for driving a capacitive load includes a power supply unit that boosts a single voltage and includes multiple voltage boosting circuits which generate power supply voltages different from each other; a drive circuit that amplifies an original drive signal based on a power supply voltage which is generated by at least one of the multiple voltage boosting circuits and generates a drive signal; in which the power supply unit controls the voltage boosting circuit, which generates the power supply voltage that is not used for amplification, to stop voltage boosting.

4 Claims, 13 Drawing Sheets

<DECODED CONTENT OF DECODER>

| | PRINTING DATA SI | T1 | | T2 | |
|---|---|---|---|---|---|
| | | Sa | Sb | Sa | Sb |
| LARGE DOT | (1, 1) | H | L | H | L |
| MEDIUM DOT | (0, 1) | H | L | L | H |
| SMALL DOT | (1, 0) | L | L | L | H |
| NO RECORD | (0, 0) | L | H | L | L |

MSB LSB

LIQUID EJECTING APPARATUS, DRIVE CIRCUIT, AND HEAD UNIT

CROSS-REFERENCE TO RELATED APPLICATIONS

This application is a continuation of U.S. patent application Ser. No. 15/007,612, filed Jan. 27, 2016, which claims priority to Japanese Patent Application No. 2015-058463, filed Mar. 20, 2015, both of which are hereby expressly incorporated by reference herein in their entireties.

BACKGROUND

1. Technical Field

The present invention relates to a liquid ejecting apparatus, a drive circuit, and a head unit.

2. Related Art

An apparatus which uses a piezoelectric element (for example, a piezo element) is known as an ink jet printer which prints an image or a document by ejecting ink. Piezoelectric elements are provided in correspondence with each of multiple nozzles in a head unit, each of the piezoelectric elements is driven in accordance with a drive signal, and thus, a predetermined amount of ink (liquid) is ejected from the nozzle at a predetermined timing to form dots. The piezoelectric element is a capacitive element such as a capacitor from a viewpoint of electricity, and needs to receive a sufficient current in order to operate the piezoelectric elements of each nozzle.

For this reason, an original drive signal is amplified by an amplification circuit, is supplied to a head unit as a drive signal, and drives the piezoelectric elements. It is recommended that an amplification circuit uses a method (linear amplification, refer to JP-A-2009-190287) of current-amplifying the original drive signal in an AB class or the like. However, since power consumption increases and energy efficiency decreases in the linear amplification, a D-class amplification is also proposed in recent years (refer to JP-A-2010-114711). In short, in the D-class amplification, a pulse width modulation or a pulse density modulation of an input signal is performed, a pair of transistors which is configured by a high side transistor and a low side transistor that are inserted in series between power supply voltages is switched in accordance with the modulated signal, an output signal which is generated by the switching is filtered by a low pass filter, and thus, the input signal is amplified.

However, in the D-class amplification method, energy efficiency increases compared to a linear amplification method, but if a piezoelectric element is driven in a wide voltage range, a power supply voltage of a pair of transistors increases. For this reason, there is room for improvement in terms of reducing power consumption.

SUMMARY

An advantage of some aspects of the invention is to provide a liquid ejecting apparatus, a drive circuit, and a head unit which reduce power consumption.

A liquid ejecting apparatus according to an aspect of the invention includes a power supply unit that boosts a single voltage and includes multiple voltage boosting circuits which generate power supply voltages different from each other; a drive circuit that amplifies an original drive signal based on a power supply voltage which is generated by at least one of the multiple voltage boosting circuits and generates a drive signal; and an ejecting unit that includes a piezoelectric element which becomes displaced in accordance with the drive signal that is applied, in which the power supply unit controls the voltage boosting circuit, that generates the power supply voltage which is not used for amplification, to stop voltage boosting.

According to the liquid ejecting apparatus of the aspect, the drive signal is generated based on at least one power supply voltage of the multiple voltage boosting circuits, and meanwhile voltage boosting is stopped for the voltage boosting circuit which generates the power supply voltage that is not used for amplification, and thus, power consumption is reduced by that amount.

In the liquid ejecting apparatus according to the aspect, voltage boosting magnifications of the multiple voltage boosting circuits may be different from each other, the multiple voltage boosting circuits may include a first voltage boosting circuit that generates a first voltage and a second voltage boosting circuit that generates a second voltage, and the second voltage boosting circuit may generate an addition voltage which is obtained by summing a value of the first voltage and a value of the second voltage and supply the addition voltage to the drive circuit.

In the liquid ejecting apparatus according to the aspect, the drive circuit may include a comparison unit that includes a first comparison unit and a second comparison unit, receives an input signal and the drive signal, and outputs a first control signal and a second control signal; and a pair of transistors that is configured by a first transistor which is controlled based on the first control signal and a second transistor which is controlled based on the second control signal, and outputs the drive signal based on a power supply voltage which is generated by at least one of the multiple voltage boosting circuits, the first comparison unit may compare a first comparison signal with a second comparison signal and output the first control signal, the first comparison signal may be a signal that is obtained by offsetting one of the input signal and the drive signal, the second comparison unit may compare a third comparison signal with a fourth comparison signal and output the second control signal, and the third comparison signal may be a signal that is obtained by offsetting one of the input signal and the drive signal.

According to the configuration, a low pass filter is not required compared to a D-class amplification method, and thus, power which is consumed in the low pass filter can be ignored.

The liquid ejecting apparatus may be used as long as the apparatus ejects liquid, and includes a three-dimensional shaping apparatus (so-called 3D printer), a textile dyeing apparatus, or the like, in addition to a printing apparatus which will be described below.

In addition, the invention is not limited to a liquid ejecting apparatus, can be realized in various aspects, and can be conceptualized as a drive circuit which drives a capacitive load such as the piezoelectric element, a head unit of a liquid ejecting apparatus, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus according to an embodiment of the invention will be described as an example with reference to the drawings.

Figure 1:
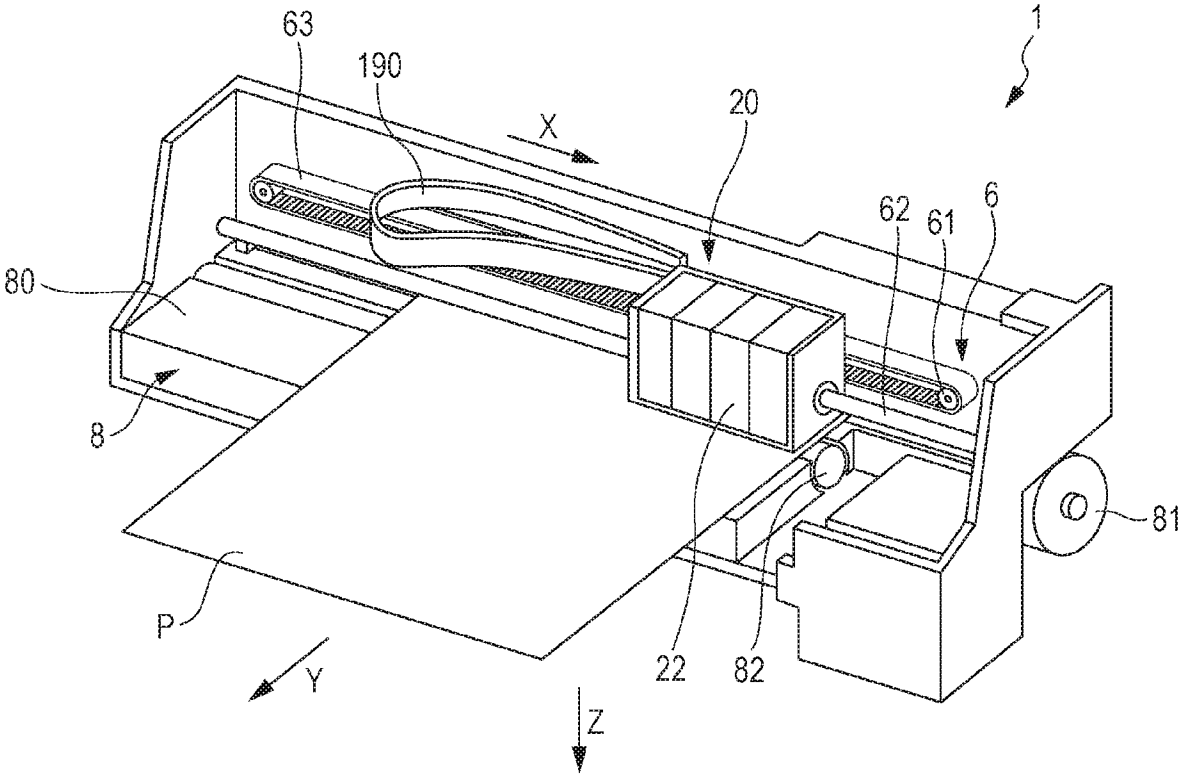
FIG. 1 is a view illustrating a schematic configuration of a printing apparatus according to an embodiment.

FIG. 1 is a perspective view illustrating a schematic configuration of a printing apparatus.

A printing apparatus 1 is a type of a liquid ejecting apparatus which forms an ink dot group on a medium P such as paper by ejecting ink as liquid, and thereby printing an image (including characters, graphics, or the like).

As illustrated in FIG. 1, the printing apparatus 1 includes a moving mechanism 6 which moves (moves back and forth) a carriage 20 in a main scanning direction (X direction).

The moving mechanism 6 includes a carriage motor 61 which moves the carriage 20, a carriage guide axis 62 both of which are fixed, and a timing belt 63 which extends substantially parallel to the carriage guide axis 62 and is driven by the carriage motor 61.

The carriage 20 is supported by the carriage guide axis 62 so as to move freely back and forth, and is fixed to a part of the timing belt 63. For this reason, if the timing belt 63 travels forward and backward by the carriage motor 61, the carriage 20 is guided by the carriage guide axis 62 and moves back and forth.

A printing head 22 is exchangeably mounted in the carriage 20. The printing head 22 includes multiple nozzles which respectively eject ink in the Z direction onto a portion which faces the medium P. The printing head 22 is divided into approximately four blocks for color printing. The multiple blocks respectively eject black (Bk) ink, cyan (C) ink, magenta (M) ink, and yellow (Y).

There is provided a configuration in which various control signals or the like, which include a drive signal from a main substrate (omitted in FIG. 1) through a flexible flat cable 190, are supplied to the carriage 20.

The printing apparatus 1 includes the medium P and a transport mechanism 8 which transports the printing head 22 on a platen 80. The transport mechanism 8 includes a transport motor 81 which is a drive source, and a transport roller 82 which is rotated by the transport motor 81 and transports the medium P in a sub-scanning direction (Y direction).

In the configuration, an image is formed on a surface of the medium P by ejecting ink in response to print data from the nozzles of the printing head 22 in accordance with main scanning of the carriage 20, and repeating an operation of transporting the medium P in accordance with the transport mechanism 8.

In the present embodiment, the main scanning is performed by moving the carriage 20, but may be performed by moving the medium P, and may be performed by moving both the carriage 20 and the medium P. The point is that there may be provided a configuration in which the medium P and the carriage 20 (printing head 22) move relatively.

Figure 2A:
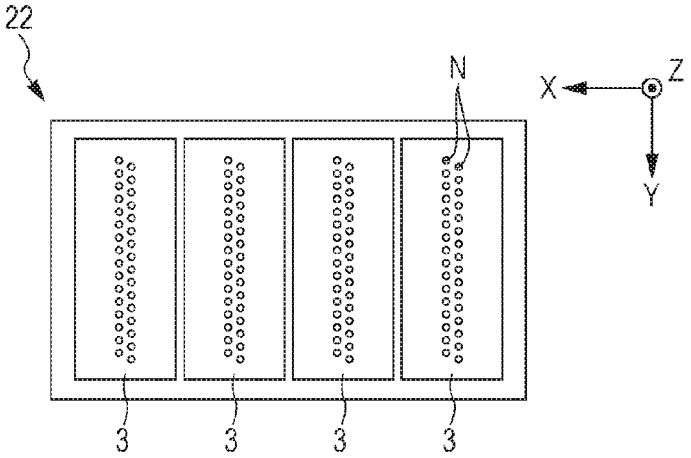
FIGS. 2A and 2B are diagrams illustrating arrangement or the like of nozzles in a head unit.

FIG. 2A is a diagram in a case in which an ejecting surface of ink in the printing head 22 is viewed from the medium P. As illustrated in FIG. 2A, the printing head 22 includes four head units 3. The four head units 3 are arranged in the X direction which is a main scanning direction in correspondence with black (Bk), cyan (C), magenta (M), and yellow (Y), respectively.

Figure 2B:
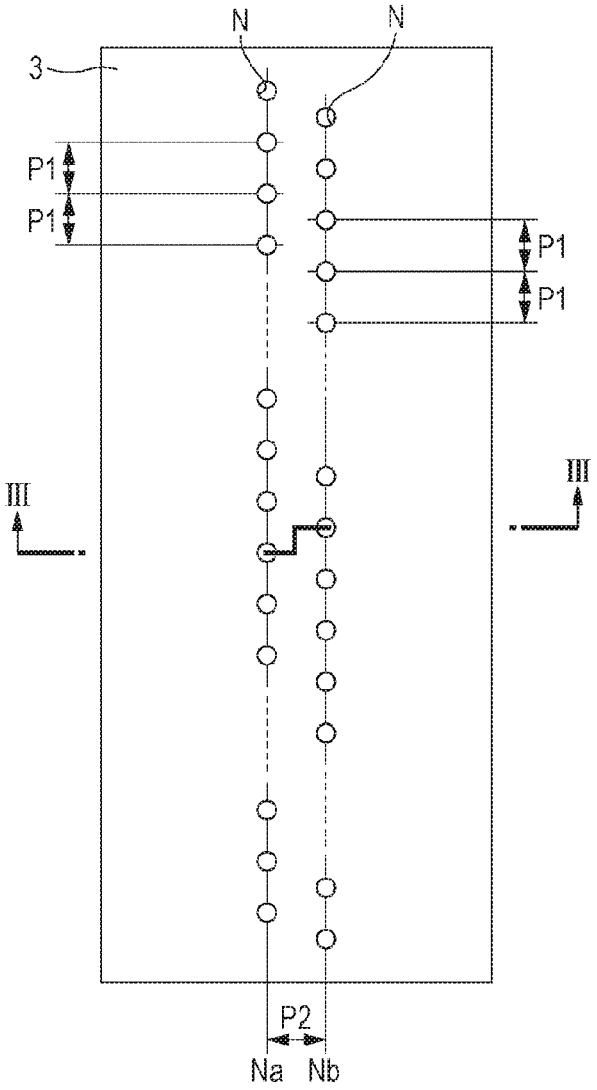

FIG. 2B is a diagram illustrating arrangement of nozzles in one head unit 3.

As illustrated in FIG. 2B, multiple nozzles are arranged in two columns in one head unit 3. For the sake of convenience, the two columns are respectively referred to as a nozzle column Na and a nozzle column Nb.

Multiple nozzles are respectively arranged in the Y direction by a pitch P1 in the nozzle columns Na and Nb. In addition, the nozzle columns Na and Nb are separated from each other by a pitch P2 in the Y direction. The nozzles N in the nozzle column Na are shifted from the nozzles N in the nozzle column Nb by half of the pitch P1 in the Y direction.

In this way, the nozzles N are arranged so as to be shifted by half of the pitch P1 in the two columns of the nozzle columns Na and Nb in the Y direction, and thereby it is possible to increase resolution in the Y direction substantially twice as much as a case of one column.

The number of nozzles N in one head unit 3 is referred to as m (m is an integer greater than or equal to 2) for the sake of convenience.

In the head unit 3, a flexible circuit board is connected to an actuator substrate, and a drive IC is mounted on the flexible circuit board. Next, a structure of the actuator substrate will be described.

Figure 3:
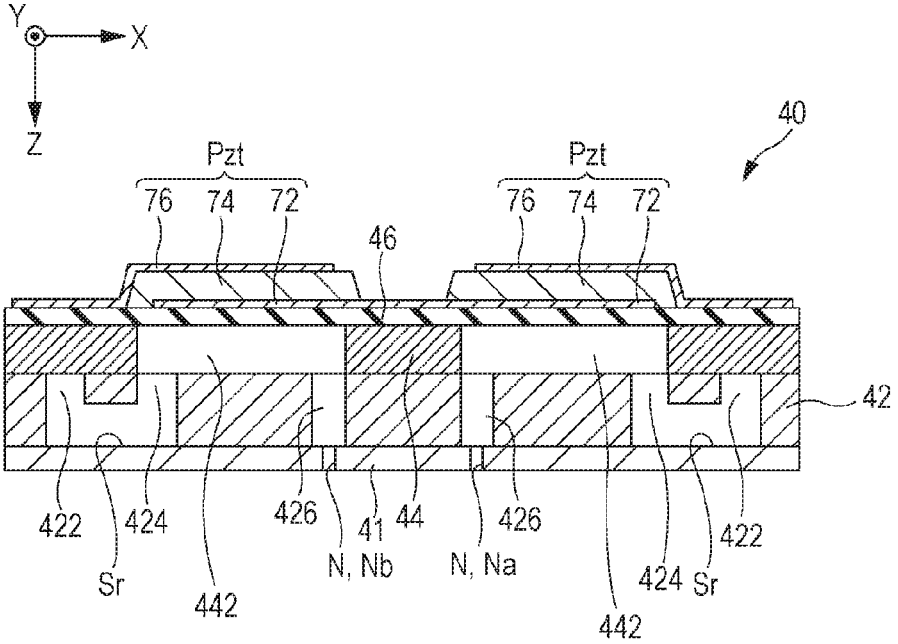
FIG. 3 is a sectional view illustrating an essential configuration of the head unit.

FIG. 3 is a sectional view illustrating a structure of the actuator substrate. In detail, FIG. 3 is a view illustrating a cross section taken along line III-III of FIG. 2B.

As illustrated in FIG. 3, the actuator substrate 40 has a structure in which a pressure chamber substrate 44 and a vibration plate 46 are provided on a surface on a negative side in the Z direction and a nozzle plate 41 is provided on a surface on a positive side in the Z direction, in a flow path substrate 42.

Schematically, each element of the actuator substrate 40 is a member of an approximately flat plate which is long in the Y direction, and is fixed to each other using, for example, an adhesive. In addition, the flow path substrate 42 and the pressure chamber substrate 44 are formed by, for example, a single crystal substrate of silicon.

The nozzles N are formed in the nozzle plate 41. A structure corresponding to the nozzles in the nozzle column Na is shifted from a structure corresponding to the nozzles in the nozzle column NB by half of the pitch P1 in the Y direction, but the nozzles are formed approximately symmetrically except for that, and thus, the structure of the actuator substrate 40 will be hereinafter described by focusing on the nozzle column Na.

The flow path substrate 42 is a flat member which forms a flow path of ink, and includes an opening 422, a supply flow path 424, and a communication flow path 426. The supply flow path 424 and the communication flow path 426 are formed in each nozzle, and the opening 422 is continuously formed over the multiple nozzles and has a structure in which ink with a corresponding color is supplied. The opening 422 functions as a liquid reservoir chamber Sr, and a bottom surface of the liquid reservoir chamber Sr is configured by, for example, the nozzle plate 41. In detail, the nozzle plate 41 is fixed to the bottom surface of the flow path substrate 42 so as to close the opening 422, the supply flow path 424, and the communication flow path 426 which are in the flow path substrate 42.

The vibration plate 46 is installed on a surface on a side opposite to the flow path substrate 42, in the pressure chamber substrate 44. The vibration plate 46 is a member of an elastically vibratile flat plate, and is configured by stacking an elastic film formed of an elastic material such as a silicon oxide, and an insulating film formed of an insulating material such as a zirconium oxide. The vibration plate 46 and the flow path substrate 42 face each other with an interval in the inner side of each opening 422 of the pressure chamber substrate 44. A space between the flow path substrate 42 and the vibration plate 46 in the inner side of each opening 422 functions as a cavity 442 which provides pressure to ink. Each cavity 442 communicates with the nozzle N through the communication flow path 426 of the flow path substrate 42.

A piezoelectric element Pzt is formed in each nozzle N (cavity 442) on a surface on a side opposite to the pressure chamber substrate 44 in the vibration plate 46.

The piezoelectric element Pzt includes a common drive electrode 72 formed over the multiple piezoelectric elements Pzt formed on a surface of the vibration plate 46, a piezoelectric body 74 formed on a surface of the drive electrode 72, and individual drive electrodes 76 formed in each piezoelectric element Pzt on a surface of the piezoelectric body 74. In the configuration, a region in which the piezoelectric body 74 is interposed between the drive electrode 72 and the drive electrode 76 which face each other, functions as the piezoelectric element Pzt.

The piezoelectric body 74 is formed in a process which includes, for example, a heating process (baking). In detail, the piezoelectric body 74 is formed by baking a piezoelectric material which is applied to a surface of the vibration plate 46 on which multiple drive electrodes 72 are formed, using heating processing of a furnace, and then molding (milling by using, for example, plasma) the baked material for each piezoelectric element Pzt.

In the same manner, the piezoelectric element Pzt corresponding to the nozzle column Nb is also configured to include the drive electrode 72, the piezoelectric body 74, and the drive electrode 76.

In addition, in this example, in the piezoelectric body 74, the common drive electrode 72 is used as a lower layer and the individual drive electrodes 76 are used as an upper layer, but in contrast to this, a configuration in which the common drive electrode 72 is used as an upper layer and the individual drive electrodes 76 are used as a lower layer, may be provided.

A configuration may be provided in which the drive IC is directly mounted in the actuator substrate 40.

As will be described below, meanwhile a voltage Vout of a drive signal according to the amount of ink to be ejected is individually applied to the drive electrode 76 which is a terminal of the piezoelectric element Pzt, a retention signal of a voltage $V_{BS}$ is commonly applied to the drive electrode 72 which is the other terminal of the piezoelectric element Pzt.

For this reason, the piezoelectric element Pzt becomes displaced upwardly or downwardly in accordance with a voltage which is applied to the drive electrodes 72 and 76. In detail, if the voltage Vout of the drive signal which is applied through the drive electrode 76 decreases, the central portion of the piezoelectric element Pzt is bent upwardly with respect to both end portions, and meanwhile, if the voltage Vout increases, the central portion of the piezoelectric element Pzt is bent downwardly.

If the central portion is bent upwardly, an internal volume of the cavity 442 increases (pressure decreases), and thus ink is drawn from the liquid reservoir chamber Sr. Meanwhile, if the central portion is bent downwardly, an internal volume of the cavity 442 decreases (pressure increases), and thus, an ink droplet is ejected from the nozzle N in accordance with the decreased degree. In this way, if a proper drive signal is applied to the piezoelectric element Pzt, ink is ejected from the nozzle N in accordance with the displacement of the piezoelectric element Pzt. For this reason, an ejecting unit which ejects ink in accordance with at least the piezoelectric element Pzt, the cavity 442, or the nozzle N, is configured.

Next, an electrical configuration of the printing apparatus 1 will be described.

Figure 4:
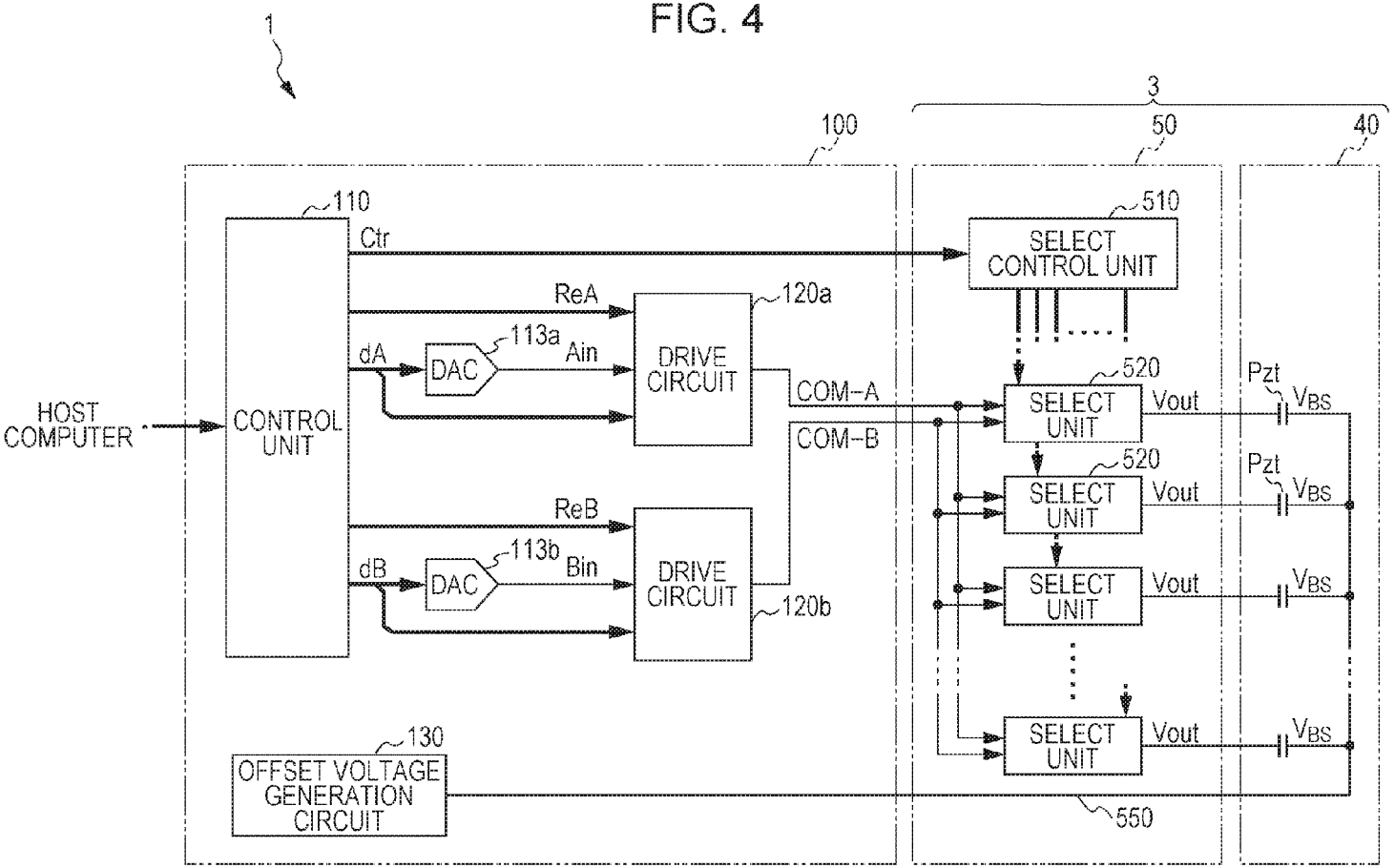
FIG. 4 is a diagram illustrating an electrical configuration of the printing apparatus.

FIG. 4 is a block diagram illustrating an electrical configuration of the printing apparatus 1.

As illustrated in FIG. 4, the printing apparatus 1 has a configuration in which the head unit 3 is coupled to a main substrate 100. The head unit 3 is largely divided into the actuator substrate 40 and a drive IC 50.

The main substrate 100 supplies a control signal Ctr or drive signals COM-A and COM-B to the drive IC 50, and supplies a retention signal of the voltage $V_{BS}$ (offset voltage) to the actuator substrate 40 through a wire 550.

In the printing apparatus 1, four head units 3 are provided, and the main substrate 100 independently controls the four head units 3. The four head units 3 are the same as each other except that the colors of ink to be ejected are different from each other, and thus, hereinafter, one head unit 3 will be representatively described for the sake of convenience.

As illustrated in FIG. 4, the main substrate 100 includes a control unit 110, D/A converters (DAC) 113*a* and 113*b*, drive circuits 120*a* and 120*b*, and a offset voltage generation circuit 130.

Among these, the control unit 110 is a type of a microcontroller having a CPU, a RAM, a ROM, and the like, and executes a predetermined program, when image data which becomes a printing target, and thereby performing printing processing such as, determining a printing processing parameter according to head identification information to be described below, and outputting various control signals for controlling each unit in accordance with the printing processing parameter.

In detail, first, the control unit 110 repeatedly supplies digital data dA to the DAC 113*a* and the drive circuit 120*a*, and repeatedly supplies digital data dB to the DAC 113*b* and the drive circuit 120*b*, in the same manner. Here, the data dA defines a waveform of the drive signal COM-A which is supplied to the head unit 3, and the data dB defines a waveform of the drive signal COM-B.

The drive signals COM-A and COM-B (and signals Ain and Bin before being amplified) have respectively trapezoidal waveforms as will be described below.

The DAC 113*a* converts the digital data dA into analog data, and supplies to the drive circuit 120*a* as a signal Ain. In the same manner, the DAC 113*b* converts the digital data dB into analog data, and supplies to the drive circuit 120*b* as a signal Bin.

The drive circuit 120*a* will be described below in detail. The drive circuit 120*a* outputs the signal Ain of a high impedance as the drive signal COM-A by voltage-amplifying and increasing drive capability (converting to low impedance), with respect to the piezoelectric element Pzt which is a capacitive load. In the same manner, the drive circuit 120*b* outputs the signal Bin as the drive signal COM-B by voltage-amplifying and increasing drive capability.

The signal Ain (Bin) which is converted by the DAC 113*a* (113*b*) swings in a range of a voltage, for example, approximately 0 V to 4 V, and in contrast to this, the drive signal COM-A (COM-B) swings in a range of a voltage, for example, approximately 0 V to 40 V. For this reason, the drive circuit 120*a* (120*b*) is configured to amplify the voltage of the signal Ain (Bin) which is converted by the DAC 113*a* (113*b*) by, for example, 10 times and to output the amplified signal.

The drive circuits 120*a* and 120*b* just have different waveforms of signals which are input, and drive signals which are output, from each other, and have the same circuit configuration as each other.

Second, the control unit 110 supplies data ReA to the drive circuit 120*a*, and supplies data ReB to the drive circuit 120*b*. The data RaA and ReB will be described below in detail.

Third, the control unit 110 supplies various control signals Ctr to the head unit 3, in synchronization with control for the moving mechanism 6 and the transport mechanism 8.

The control signals Ctr which are supplied to the head unit 3 include print data (ejecting control signal) which defines the amount of ink which is ejected from the nozzle N, a clock signal which is used for transmission of the print data, a timing signal which defines a print period or the like, or the like.

The control unit 110 controls the moving mechanism 6 and the transport mechanism 8, but since a configuration thereof is known, and thus description thereof will be omitted.

The offset voltage generation circuit 130 in the main substrate 100 generates a retention signal of the voltage $V_{BS}$ and output the retention signal to the wire 550. The voltage $V_{BS}$ maintains the other terminals of the multiple piezoelectric elements Pzt in the actuator substrate 40 in a constant state.

Meanwhile, in the head unit 3, the drive IC 50 includes a select control unit 510 and select units 520 which correspond to the piezoelectric elements Pzt one to one. The select control unit 510 controls selection of each of the select units 520. In detail, the select control unit 510 stores the print data which is supplied in correspondence with a clock signal from the control unit 110 in several nozzles (piezoelectric elements Pzt) of the head unit 3 once, and instructs each select unit 520 to select the drive signals COM-A and COM-B in accordance with the print data at a start timing of a print period which is defined by a timing signal.

Each select unit 520 selects (or does not select any one) one of the drive signals COM-A and COM-B in accordance with instruction of the select control unit 510, and applies the selected signal to one terminal of the corresponding piezoelectric element Pzt as a drive signal of the voltage Vout.

As described above, one piezoelectric element Pzt is provided in each nozzle N in the actuator substrate 40. The other terminals of each piezoelectric element Pzt are coupled in common, and the voltage $V_{BS}$ from the offset voltage generation circuit 130 is applied to the other terminals through the wire 550.

In the present embodiment, ink is ejected from one nozzle N maximum twice by one dot, and thus four gradations of a large dot, a medium dot, a small dot, and no record are represented. In the present embodiment, in order to represent the four gradations, two types of the drive signals COM-A and COM-B are prepared, and each period has first half pattern and a second half pattern. Then, during one period, the drive signals COM-A and COM-B are selected (or not selected) in accordance with a gradation to be represented in the first half and a second half, and the selected signal is supplied to the piezoelectric element Pzt.

Thus, the drive signals COM-A and COM-B will be first described, and thereafter, a detailed configuration of the select control unit 510 for selecting the drive signals COM-A and COM-B, and the select unit 520 will be described.

Figure 5:
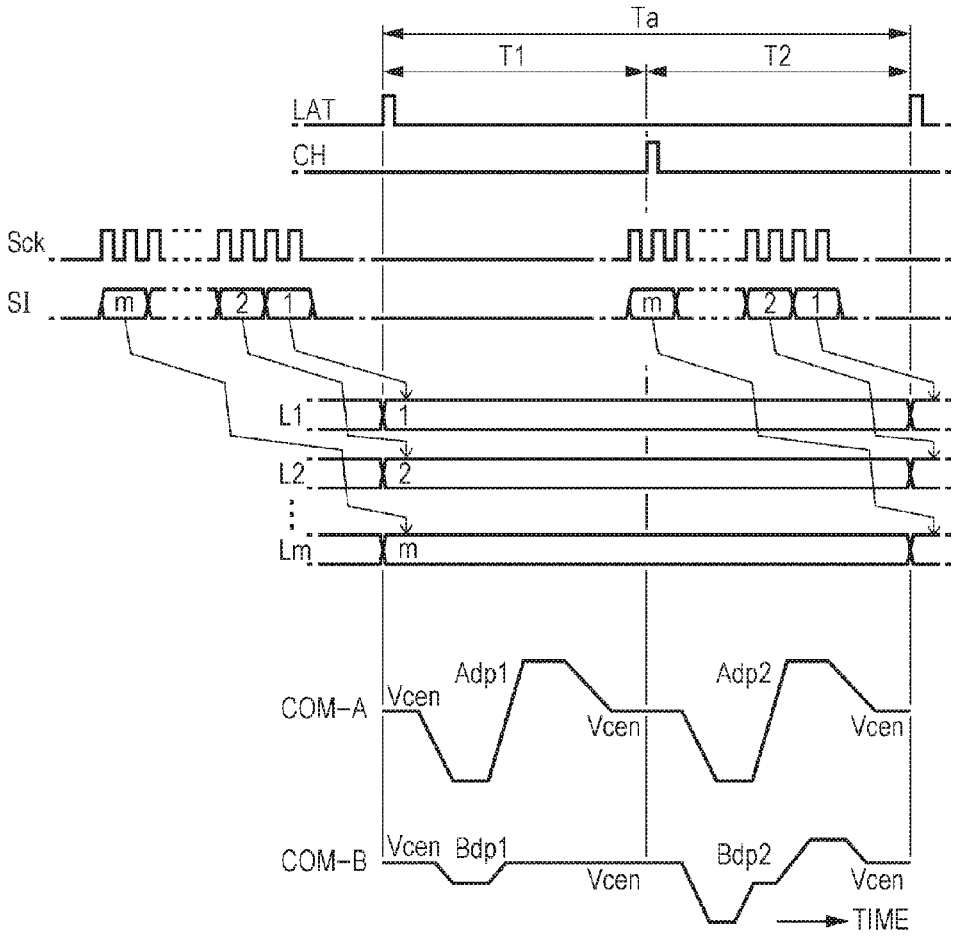
FIG. 5 is a diagram illustrating waveforms or the like of drive signals.

FIG. 5 is a diagram illustrating waveforms or the like of drive signals COM-A and COM-B.

As illustrated in FIG. 5, the drive signal COM-A is configured by a repeated waveform of a trapezoidal waveform Adp1 which is disposed during a period T1 from time when a control signal LAT is output (rises) to time when a control signal CH is output, during a print period Ta, and a trapezoidal waveform Adp2 which is disposed during a period T2 from time when the control signal CH is output and to the control signal LAT is output.

The drive signals COM-A and COM-B illustrated in FIG. 5 illustrate standard waveforms before modification to be described below.

In the present embodiment, the trapezoidal waveforms Adp1 and Adp2 are approximately the same waveforms as each other, and are waveforms which respectively eject a predetermined amount of ink, in detail, an approximately medium amount of ink from the nozzles corresponding to the piezoelectric elements Pzt, if each of the trapezoidal waveforms Adp1 and Adp2 is supplied to the one terminal of the piezoelectric element Pzt.

The drive signal COM-B is configured by a repeated waveform of a trapezoidal waveform Bdp1 which is disposed during the period T1 and a trapezoidal waveform Bdp2 which is disposed during the period T2. In the present embodiment, the trapezoidal waveforms Bdp1 and Bdp2 are waveforms different form each other. Among these, the trapezoidal waveform Bdp1 is a waveform for preventing an increase of viscosity of ink by slightly vibrating the ink near the nozzle N. For this reason, even if the trapezoidal waveform Bdp1 is supplied to the one terminal of the piezoelectric element Pzt, ink is not ejected from the nozzle N corresponding to the piezoelectric element Pzt. In addition, the trapezoidal waveform Bdp2 is a waveform different from the trapezoidal waveform Adp1 (Adp2). If the trapezoidal waveform Bdp2 is supplied to the one terminal of the piezoelectric element Pzt, the trapezoidal waveform Bdp2 becomes a waveform which ejects the amount of ink less than the predetermined amount from the nozzle N corresponding to the piezoelectric element Pzt.

Voltages at a start timing of the trapezoidal waveforms Adp1, Adp2, Bdp1, and Bdp2, and voltages at an end timing of the trapezoidal waveforms Adp1, Adp2, Bdp1, and Bdp2 are all common at a voltage Vcen. That is, the trapezoidal waveforms Adp1, Adp2, Bdp1, and Bdp2 are waveforms which respectively start at the voltage Vcen and ends at the voltage Vcen.

Since the drive circuit 120*a* (120*b*) outputs a voltage of the signal Ain (Bin) by amplifying 10 times as described above, the Ain (Bin) which is input includes an error which will be described below, and has a waveform in which a voltage of the drive signal COM-A (COM-B) is used as 1/10 as it is.

Figures 6, 7:
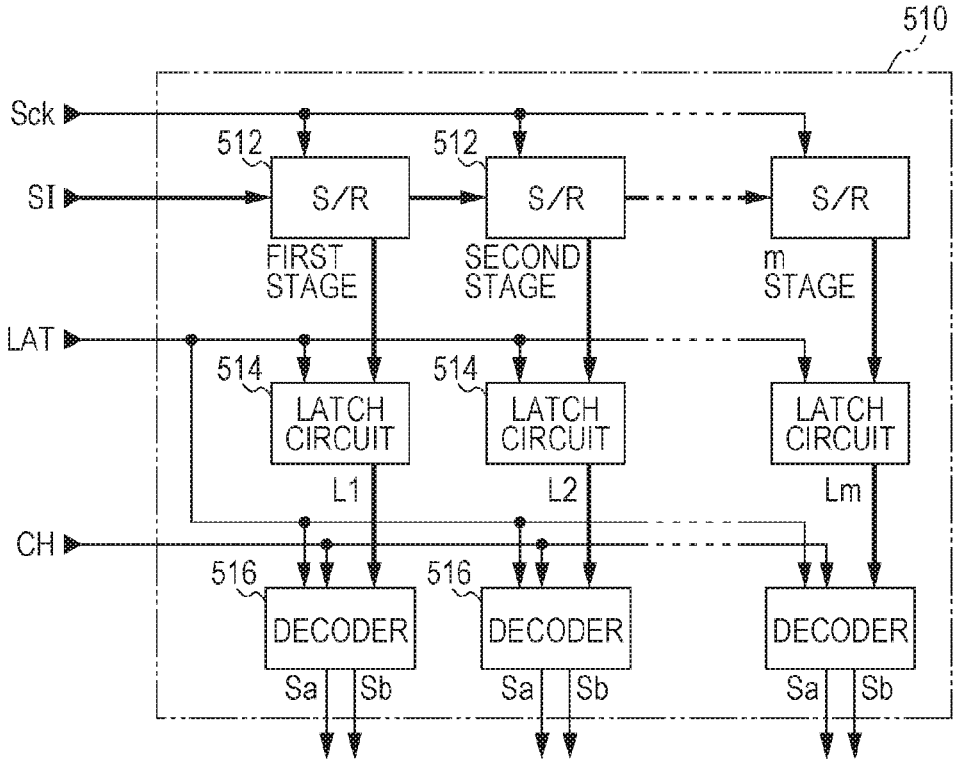
FIG. 6 is a diagram illustrating a configuration of a select control unit.
FIG. 7 is a diagram illustrating decoded content of a decoder.

FIG. 6 is a diagram illustrating a configuration of the select control unit 510 of FIG. 4.

As illustrated in FIG. 6, a clock signal Sck, the print data SI, and the control signals LAT and CH are supplied to the select control unit 510. Multiple sets of a shift register (S/R) 512, a latch circuit 514, and a decoder 516 are provided in correspondence with each of the piezoelectric elements Pzt (nozzles N) in the select control unit 510.

The print data SI is data which defines dots to be formed by all the nozzles N in the head unit 3 which is focused during the print period Ta. In the present embodiment, in order to represent the four gradations of no record, a small dot, a medium dot, and a large dot, the print data for one nozzle is configured by two bits of a most significant bit (MSB) and a least significant bit (LSB).

The print data SI is supplied in accordance with transport of the medium P for each nozzle N (piezoelectric element Pzt) in synchronization with the clock signal Sck. The shift register 512 has a configuration in which the print data SI of two bits is retained once in correspondence with the nozzle N.

In detail, shift registers 512 of total m stages corresponding to each of m piezoelectric elements Pzt (nozzles) are coupled in cascade, and the print data SI which is supplied to the shift register 512 of a first stage located at a left end of FIG. 6 is sequentially transmitted to the rear stage (downward side) in accordance with the clock signal Sck.

In FIG. 6, in order to separate the shift registers 512, the shift register 512 are sequentially referred to as a first stage, a second stage, . . . , an mth stage from an upper side to which the print data SI is supplied.

The latch circuit 514 latches the print data SI retained in the shift register 512 at a rising edge of the control signal LAT.

The decoder 516 decodes the print data SI of two bits which are latched in the latch circuit 514, outputs select signals Sa and Sb for each of periods T1 and T2 which are defined by the control signal LAT and the control signal CH, and defines select of the select unit 520.

FIG. 7 is a diagram illustrating decoded content of the decoder 516.

In FIG. 7, the print data SI of two bits which are latched is referred to as an MSB and an LSB. In the decoder 516, if the latched print data SI is (0,1), it means that logic levels of the select signals Sa and Sb are respectively output as levels of H and L during the period T1, and levels of L and H during the period T2.

The logic levels of the select signals Sa and Sb are level-shifted by a level shifter (not illustrated) to a higher amplitude logic than the logic levels of the clock signal Sck, the print data SI, and the control signals LAT and CH.

Figure 8:
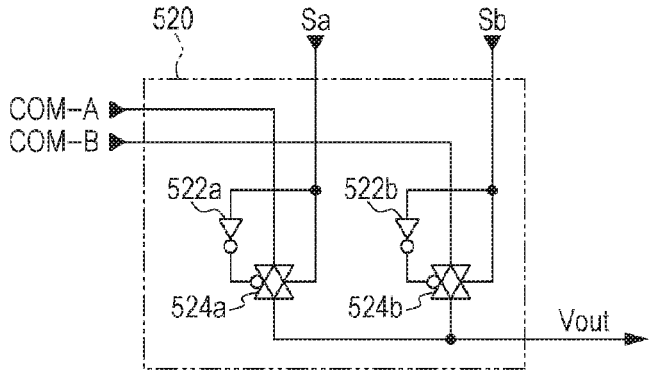
FIG. 8 is a diagram illustrating a configuration of a select unit.

FIG. 8 is a diagram illustrating a configuration of the select unit 520 of FIG. 4.

As illustrated in FIG. 8, the select unit 520 includes inverters (NOT circuit) 522*a* and 522*b*, and transfer gates 524*a* and 524*b*.

The select signal Sa from the decoder 516 is supplied to a positive control terminal to which a round mark is not attached in the transfer gate 524*a*, is logically inverted by the inverter 522*a*, and is supplied to a negative control terminal to which a round mark is attached in the transfer gate 524*a*. In the same manner, the select signal Sb is supplied to a positive control terminal of the transfer gate 524*b*, is logically inverted by the inverter 522*b*, and is supplied to a negative control terminal of the transfer gate 524*b*.

The drive signal COM-A is supplied to an input terminal of the transfer gate 524*a*, and the drive signal COM-B is supplied to an input terminal of the transfer gate 524*b*. The output terminals of the transfer gates 524*a* and 524*b* are coupled to each other, and are coupled to one terminal of the corresponding piezoelectric element Pzt.

If the select signal Sa goes to an H level, the input terminal and the output terminal of the transfer gate 524*a* are electrically coupled (ON) to each other. If the select signal Sa goes to an L level, the input terminal and the output terminal of the transfer gate 524*a* are electrically decoupled (OFF) from each other. In the same manner, the input terminal and the output terminal of the transfer gate 524*b* are also electrically coupled to each other or decoupled from each other in accordance with the select signal Sb.

As illustrated in FIG. 5, the print data SI is supplied to each nozzle in synchronization with the clock signal Sck, and is sequentially transmitted to the shift registers 512 corresponding to the nozzles. Thus, if supply of the clock signal Sck is stopped, the print data SI corresponding to each nozzle is retained in each of the shift registers 512.

If the control signal LAT rises, each of the latch circuits 514 latches all of the print data SI retained in the shift registers 512. In FIG. 5, the number in L1, L2, . . . , Lm indicate the print data SI which is latched by the latch circuits 514 corresponding to the shift registers 512 of the first stage, the second stage, . . . , the mth stage.

The decoder 516 outputs the logic levels of the select signals Sa and Sb in the content illustrated in FIG. 7 in accordance with the size of the dots which are defined by the latched print data SI during the periods T1 and T2.

That is, first, the decoder 516 sets the select signals Sa and Sb to levels of H and L during the period T1 and levels of H and L even during the period T2, if the print data SI is (1,1) and the size of the large dot is defined. Second, the decoder 516 sets the select signals Sa and Sb to levels of H and L during the period T1 and levels of L and H during the period T2, if the print data SI is (0,1) and the size of the medium dot is defined. Third, the decoder 516 sets the select signals Sa and Sb to levels of L and L during the period T1 and levels of L and H during the period T2, if the print data SI is (1,0) and the size of the small dot is defined. Fourth, the decoder 516 sets the select signals Sa and Sb to levels of L and H during the period T1 and levels of L and L during the period T2, if the print data SI is (0,0) and no recode is defined.

Figure 9:
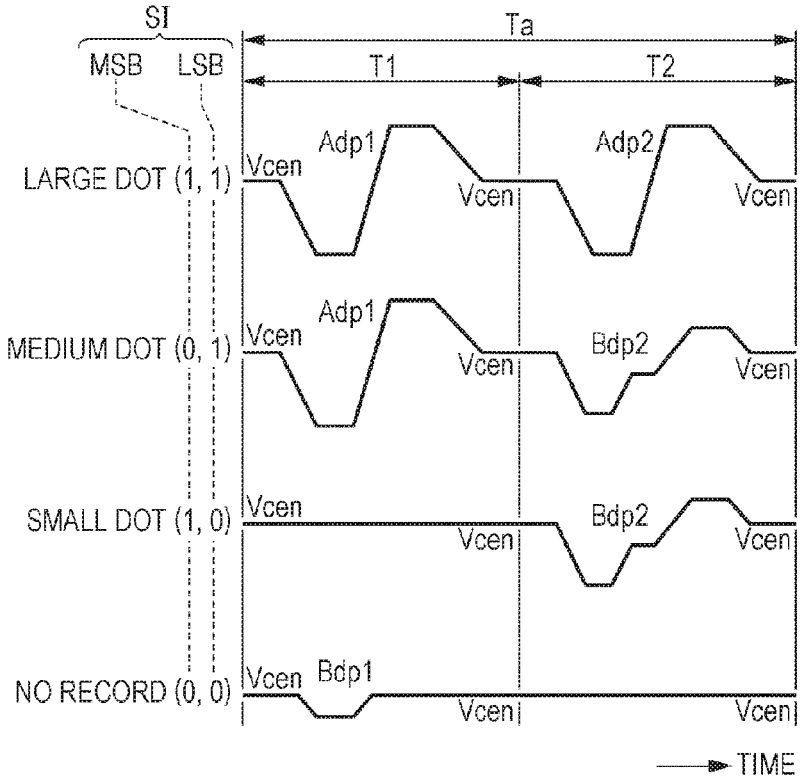
FIG. 9 is a diagram illustrating drive signals which are selected by the select unit and are supplied to a piezoelectric element.

FIG. 9 is a diagram illustrating waveforms of the drive signals which are selected in accordance with the print data SI and are supplied to one terminal of the piezoelectric element Pzt.

When the print data SI is (1,1), the select signals Sa and Sb become H and L levels during the period T1, and thus the transfer gate 524*a* is turned on, and the transfer gate 524*b* is turned off. For this reason, the trapezoidal waveform Adp1 of the drive signal COM-A is selected during the period T1. Since the select signals Sa and Sb go to H and L levels even during the period T2, the select unit 520 selects the trapezoidal waveform Adp2 of the drive signal COM-A.

In this way, if the trapezoidal waveform Adp1 is selected during the period T1, the trapezoidal waveform Adp2 is selected during the period T2, and the selected waveforms are supplied to one terminal of the piezoelectric element Pzt as drive signals, ink of an approximately medium amount is ejected twice from the nozzle N corresponding to the piezoelectric element Pzt. For this reason, each ink is landed on and combined with the medium P, and as a result, a large dot is formed as defined by the print data SI.

When the print data SI is (0,1), the select signals Sa and Sb become H and L levels during the period T1, and thus the transfer gate 524*a* is turned on, and the transfer gate 524*b* is turned off. For this reason, the trapezoidal waveform Adp1 of the drive signal COM-A is selected during the period T1. Next, since the select signals Sa and Sb go to L and H levels during the period T2, the trapezoidal waveform Bdp2 of the drive signal COM-B is selected.

Hence, ink of an approximately medium amount and an approximately small amount is ejected twice from the nozzle N. For this reason, each ink is landed on and combined with the medium P, and as a result, a medium dot is formed as defined by the print data SI.

When the print data SI is (1,0), the select signals Sa and Sb become all L levels during the period T1, and thus the transfer gates 524*a* and 524*b* are turned off. For this reason, the trapezoidal waveforms Adp1 and Bdp1 are not selected during the period T1. If the transfer gates 524*a* and 524*b* are all turned off, a path from a connection point of the output terminals of the transfer gates 524*a* and 524*b* to one terminal of the piezoelectric element Pzt becomes a high impedance state in which the path is not electrically coupled to any portion. However, both terminals of the piezoelectric element Pzt retain a voltage ($Vcen-V_{BS}$) shortly before the transfer gates are turned off, by capacitance included in the piezoelectric element Pzt itself.

Next, since the select signals Sa and Sb go to L and H levels during the period T2, the trapezoidal waveform Bdp2 of the drive signal COM-B is selected. For this reason, ink of an approximately small amount is ejected from the nozzle N only during the period T2, and thus small dot is formed on the medium P as defined by the print data SI.

When the print data SI is (0,0), the select signals Sa and Sb become L and H levels during the period T1, and thus the transfer gates 524*a* is turned off and the transfer gate 524*b* is turned on. For this reason, the trapezoidal waveforms Bdp1 of the drive signal COM-B is selected during the period T1. Next, since all of the select signals Sa and Sb go to L levels during the period T2, the trapezoidal waveforms Adp2 and Bdp2 are all not selected.

For this reason, ink near the nozzle N just slightly vibrates during the period T1, and the ink is not ejected, and thus, as a result, dots are not formed, that is, no record is made as defined by the print data SI.

In this way, the select unit 520 selects (or does not select) the drive signals COM-A and COM-B in accordance with instruction of the select control unit 510, and applies the selected signal to one terminal of the piezoelectric element Pzt. For this reason, each of the piezoelectric elements Pzt is driven in accordance with the size of the dot which is defined by the print data SI.

The drive signals COM-A and COM-B illustrated in FIG. 5 are just an example. Actually, combinations of various waveforms which are prepared in advance are used in accordance with properties, transport speed, or the like of the medium P.

In addition, here, an example in which the piezoelectric element Pzt is bent upwardly in accordance with a decreases of a voltage is used, but if a voltage which is applied to the drive electrodes 72 and 76 is inverted, the piezoelectric element Pzt is bent downwardly in accordance with a decrease of the voltage. For this reason, in a configuration in which the piezoelectric element Pzt is ent downwardly in accordance with a decrease of a voltage, the drive signals COM-A and COM-B illustrated in the figure have waveforms which are inverted by using the voltage Vcen as a reference.

Next, with regard to the drive circuits 120*a* and 120*b* in the main substrate 100, an example in which the drive circuit 120*a* that outputs the drive signal COM-A is used will be used, but parts of parentheses represent a case in which the drive circuit 120*b* is used.

Figure 10:
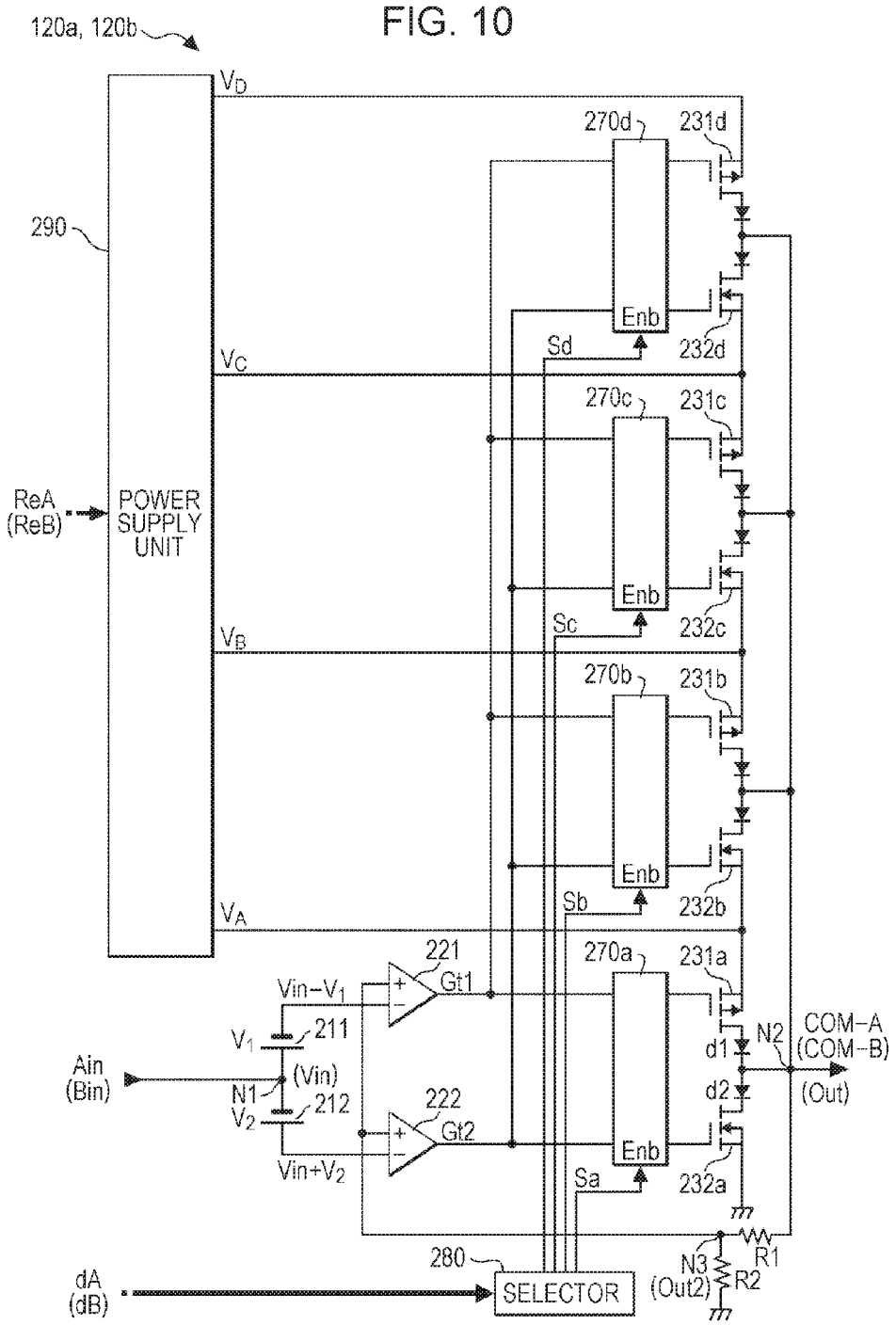
FIG. 10 is a diagram illustrating a configuration of a drive circuit.

FIG. 10 is a diagram illustrating a configuration of the drive circuit 120*a*.

As illustrated in FIG. 10, the drive circuit 120*a* includes reference power supplies 211 and 212, comparators 221 and 222, level shifters 270*a*, 270*b*, 270*c*, and 270*d*, a selector 280, a power supply unit 290, four pairs of transistors, and resistor elements R1 and R2. The drive circuit 120*a* (120*b*) may except the power supply unit 290.

The reference power supply (first offset unit) 211 outputs a voltage $V_1$ between a positive terminal and a negative terminal thereof. Here, the positive terminal of the reference power supply 211 is coupled to a terminal N1 to which a voltage Vin of the signal Ain is supplied from a voltage amplifier 115*a* (refer to FIG. 4), and the negative terminal of the reference power supply 211 is coupled to a negative input terminal (−) of the comparator 221. For this reason, a voltage ($Vin-V_1$) which is obtained by subtracting the voltage $V_1$ from the voltage Vin that is an input signal is applied to the negative input terminal (−) of the comparator 221. The positive input terminal (+) of the comparator 221 is coupled to a terminal N3.

The terminal N3 is coupled to a terminal N1 from which the voltage Out is output through the resistor element R1, and is coupled to the ground Gnd of zero volts through the resistor element R2. A voltage Out2 of the terminal N3 is a voltage which drops in a ratio between resistance values of the resistor elements R1 and R2. In the present embodiment, the drop ratio is set to 1/10 of an inverse number of a voltage amplification factor of the drive circuit 120*a*. That is, the voltage Out2 has a relationship of (equal voltage Out/10).

The comparator (first comparison unit) 221 outputs a signal Gt1 which is obtained by comparing a voltage applied to the positive input terminal (+) with a voltage applied to the negative input terminal (−), as a first control signal. In detail, the comparator 221 outputs the signal Gt1 with an H level, if the voltage Out2 applied to the positive input terminal (+) is higher than or equal to the voltage ($Vin-V_1$) applied to the negative input terminal (−), and outputs the signal Gt1 with an L level, if the voltage Out2 is lower than the voltage ($Vin-V_1$).

Here, in the comparator 221, if a signal of the voltage ($Vin-V_1$) applied to the negative input terminal (−) is set as a first comparison signal, a signal of the voltage Out2 applied to the positive input terminal (+) is set as a second comparison signal in which a signal based on the drive signal is offset to zero volts.

Meanwhile, the reference power supply (second offset unit) 212 outputs a voltage $V_2$ between a positive terminal and a negative terminal thereof. Here, the negative terminal of the reference power supply 212 is coupled to the terminal N1, and the positive terminal of the reference power supply 212 is coupled to a negative input terminal (−) of the comparator 222. For this reason, a voltage (Vin+$V_2$) which is obtained by adding the voltage $V_2$ to the voltage Vin that is an input signal is applied to the negative input terminal (−) of the comparator 221. The positive input terminal (+) of the comparator 221 (second comparator) is coupled to the terminal N3.

The comparator 222 outputs a signal Gt2 which is obtained by comparing a voltage applied to the positive input terminal (+) with a voltage applied to the negative input terminal (−), as a second control signal. In detail, the comparator 222 outputs the signal Gt2 with an H level, if the voltage Out2 applied to the positive input terminal (+) is higher than or equal to the voltage (Vin+$V_2$) applied to the negative input terminal (−), and outputs the signal Gt2 with an L level, if the voltage Out2 is lower than the voltage (Vin+$V_2$).

Here, in the comparator 222, if a signal of the voltage (Vin+$V_2$) applied to the negative input terminal (−) is set as a third comparison signal, a signal of the voltage Out2 applied to the positive input terminal (+) is set as a fourth comparison signal in which a signal based on the drive signal is offset to zero volts.

With regard to logic levels of the signal Gt1 which is output from the comparator 221 and the signal Gt2 which is output from the comparator 222, for example, an H level indicates 4 V which is a maximum voltage of the signal Ain (Bin) and the terminal N3, and an L level indicates the ground Gnd of zero volts.

The power supply unit 290 outputs four volts of $V_A$, $V_B$, $V_C$, and $V_D$.

Figure 11:
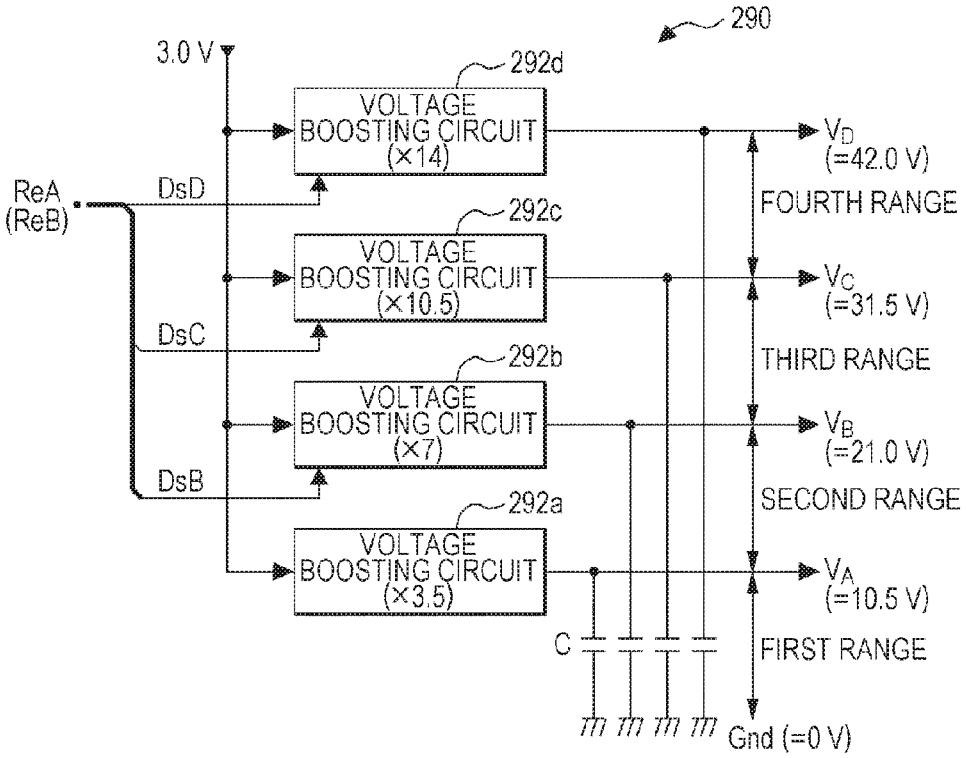
FIG. 11 is a diagram illustrating a configuration of a power supply unit of the drive circuit.

FIG. 11 is a diagram illustrating a configuration of the power supply unit 290. As illustrated in FIG. 11, the power supply unit 290 includes voltage boosting circuits 292*a*, 292*b*, 292*c*, and 292*d*. The voltage boosting circuits 292*a*, 292*b*, 292*c*, and 292*d* are DC/DC converts using, for example, a charge pump method or the like, and sequentially outputs voltages which are obtained by boosting 3.0 V to different magnifications, as the voltages $V_A$, $V_B$, $V_C$, and $V_D$. In this example, each boosting rate of the voltage boosting circuits 292*a*, 292*b*, 292*c*, and 292*d* is sequentially 3.5 times, 7 times, 10.5 times, and 14 times, and for this reason, the voltage $V_A$ becomes 10.5 V, the voltage $V_B$ becomes 21.0 V, the voltage $V_C$ becomes 31.5 V, and the voltage $V_D$ becomes 42.0 V.

Four capacitors C, which respectively have one terminal coupled to each output of the voltage boosting circuits 292*a*, 292*b*, 292*c*, and 292*d*, is used for backup. For this reason, the other terminals of the four capacitors C is not limited to being coupled to the ground Gnd, may be coupled to a predetermined potential. For example, the four capacitors C may be electrically coupled respectively and sequentially between the voltage $V_A$ and the ground Gnd, between voltages $V_B$ and $V_A$, between voltages $V_C$ and $V_B$, and between voltages $V_D$ and $V_C$.

In the present embodiment, data ReA which is supplied to the drive circuit 120*a* is configured by three bits of signals DsB, DsC, and DsD. The signal DsB commands the voltage boosting circuit 292*b* to stop, for example, a voltage boosting operation, using an H level, and commands the voltage boosting circuit 292*b* to allow the voltage boosting operation, using an L level. In the same manner, the signals DsC and DsD command the voltage boosting circuits 292*c* and 292*d* to stop the voltage boosting operation, using an H level, and commands the voltage boosting circuit 292*b* to allow the voltage boosting operation, using an L level.

In the same manner, data ReB which is supplied to the drive circuit 120*b* is also configured by three bits.

The data ReA (ReB) is set in accordance with rank information of the printing head 22 by the control unit 110.

As described above, the printing head 22 is exchangeable to the carriage 20, but characteristics of the piezoelectric element Pzt may be different for each printing head 22 (actuator substrate 40). For example, if there is also a case in which the piezoelectric element Pzt of a certain printing head 22 achieves a predetermined displacement amount at a certain voltage change, and in contrast to this, the piezoelectric element Pzt of another printing head 22 achieves the predetermined displacement amount at, for example, 2/3 of a voltage change, there is also a case in which 1.2 times of a voltage change is required. For this reason, when the printing head 22 is exchanged, there is a possibility that printing quality is not maintained constant due to that characteristics of the piezoelectric element Pzt are changed and the ejecting amount of ink becomes different.

Hence, head identification information including rank information relating to characteristics or the like of the piezoelectric element Pzt is individually provided to and stored in the printing head 22. When exchanging, the control unit 110 reads the head identification information, and changes the waveforms of the standard drive signals COM-A and COM-B in accordance with the rank information included in the head identification information (changes wave peak values of data dA and dB). By doing so, even when the printing head 22 is exchanged, it is possible to maintain printing quality in the same manner.

Roughly speaking, the change of the waveforms of the drive signals COM-A and COM-B is processing of increasing or decreasing a voltage value of a trapezoidal waveform in accordance with rank information by using the ground Gnd as a reference, but peak and bottom values, slope, flat time, or the like can be changed.

If the piezoelectric elements Pzt of the printing head 22 are sorted as a standard product, an efficient product, and an excellent product in accordance with rank information, the control unit 110 sets three bits of the signals DsB, DsC, and DsD of the data ReA (ReB) to the following levels.

The efficient product means that the piezoelectric element Pzt can obtain a certain displacement amount by using a voltage change less than that of the standard product, and specifically, maximum voltage values of the changed drive signals COM-A and COM-B are terminated at values lower than 31.5 V. In addition, the excellent product means that the piezoelectric element Pzt can obtain a certain displacement amount by using a voltage change less than that of the efficient product, and specifically, maximum voltage values of the changed drive signals COM-A and COM-B are terminated at values lower than 21.0 V.

If the printing head 22 is sorted as a standard product, the control unit 110 sets all the three bits of the signals DsB, DsC, and DsD of the data ReA (ReB) to an L level, and allows the voltage boosting circuits 292*a*, 292*b*, 292*c*, and 292*d* to perform a voltage boosting operation.

In addition, if the changed printing head 22 is sorted as an efficient product, the control unit 110 sets the signals DsB and DsC to an L level, sets the signal DsD to an H level, and controls the voltage boosting circuit 292*d* to stop a voltage boosting operation.

Hence, if the changed printing head 22 is sorted as an excellent product, the control unit 110 sets the signal DsB to an L level, sets the signals DsC and DsD to an H level, and controls the voltage boosting circuit 292*c* to stop a voltage boosting operation, in addition to the voltage boosting circuit 292*d*.

Hereinafter, a case in which the printing head 22 is a standard product as a general rule will be described as an example.

In addition, in FIG. 11, the following voltage ranges are defined in accordance with the voltages $V_A$, $V_B$, $V_C$, and $V_D$. That is, voltages higher than or equal to zero volts and lower than the voltage $V_A$ are defined as a first range, voltages higher than or equal to the voltage $V_A$ and lower than the voltage $V_B$ are defined as a second range, voltages higher than or equal to the voltage $V_B$ and lower than the voltage $V_C$ are defined as a third range, and voltages higher than or equal to the voltage $V_C$ and lower than the voltage $V_D$ are defined as a fourth range.

The description returns to FIG. 10. The selector 280 discriminates a voltage range of the voltage Vin of the signal Ain (Bin) from the data dA (dB) which is supplied from the control unit 110 (refer to FIG. 4), and outputs select signals Sa, Sb, Sc, and Sd in accordance with the discrimination result as follows.

In detail, if the voltage Vin which is defined by the data dA (dB) is discriminated as voltages higher than or equal to 0 V and lower than 1.05 V, that is, if a voltage at the time of amplifying the voltage Vin 10 times is included in the first range, the selector 280 sets only the select signal Sa to an H level, and sets the other select signals Sb, Sc, and Sd to an L level. In addition, if the voltage Vin which is defined by the data dA (dB) is discriminated as voltages higher than or equal to 1.05 V and lower than 2.10 V, that is, if a voltage at the time of amplifying the voltage Vin 10 times is included in the second range, the selector 280 sets only the select signal Sb to an H level, and sets the other select signals Sa, Sc, and Sd to an L level. In the same manner, if the voltage Vin which is defined by the data dA (dB) is discriminated as voltages higher than or equal to 2.10 V and lower than 3.15 V, that is, if a voltage at the time of amplifying the voltage Vin 10 times is included in the third range, the selector 280 sets only the select signal Sc to an H level, and sets the other select signals Sa, Sb, and Sd to an L level. If the voltage Vin is discriminated as voltages higher than or equal to 3.15 V and lower than 4.20 V, that is, if a voltage at the time of amplifying the voltage Vin 10 times is included in the fourth range, the selector 280 sets only the select signal Sd to an H level, and sets the other select signals Sb, Sc, and Sd to an L level.

When enabled, the level shifter 270*a* shifts logic levels of the signal Gt1 and Gt2, and supplies the shifted signals to gates of transistors 231*a* and 232*a*. In detail, when the select signal Sa goes to an H level, the level shifter 270*a* is enabled, shifts an H level of the signal Gt1 to, for example, the voltage $V_A$ (=10.5 V), shifts an L level to, for example, the ground Gnd (zero volts), and supplies the shifted signal to a gate electrode of the transistor 231*a*. In addition, the level shifter 270*a* shifts an H level of the signal Gt2 to the voltage $V_A$, shifts an L level to the ground Gnd, and supplies the shifted signal to a gate electrode of the transistor 232*a*.

When the select signal Sb goes to an H level, the level shifter 270*b* is enabled, shifts an H level of the signal Gt1 to, for example, the voltage $V_B$ (=21.0 V), shifts an L level to, for example, the voltage $V_A$ (=10.5 V), and supplies the shifted signal to a gate electrode of the transistor 231*b*. In addition, the level shifter 270*b* shifts an H level of the signal Gt2 to the voltage $V_B$, shifts an L level to the voltage $V_A$, and supplies the shifted signal to a gate electrode of the transistor 232*b*.

In the same manner, when the select signal Sc goes to an H level, the level shifter 270*c* is enabled, shifts an H level of the signal Gt1 to, for example, the voltage $V_C$ (=31.5 V), shifts an L level to, for example, the voltage $V_B$ (=21.0 V), and supplies the shifted signal to a gate electrode of the transistor 231*c*. In addition, the level shifter 270*b* shifts an H level of the signal Gt2 to the voltage $V_C$, shifts an L level to the voltage $V_B$, and supplies the shifted signal to a gate electrode of the transistor 232*c*.

Then, when the select signal Sd goes to an H level, the level shifter 270*d* is enabled, shifts an H level of the signal Gt1 to, for example, the voltage $V_D$ (=42.0 V), shifts an L level to, for example, the voltage $V_C$ (=31.5 V), and supplies the shifted signal to a gate electrode of the transistor 231*d*. In addition, the level shifter 270*b* shifts an H level of the signal Gt2 to the voltage $V_D$, shifts an L level to the voltage $V_C$, and supplies the shifted signal to a gate electrode of the transistor 232*d*.

If disabled, that is, if corresponding select signals go to an L level, the level shifters 270*a*, 270*b*, 270*c*, and 270*d* respectively output signals which respectively turn off corresponding two transistors. If disabled, that is, if channels of corresponding two transistors are the types which will be described next, the level shifters 270*a*, 270*b*, 270*c*, and 270*d* forcibly change the signal Gt1 into a signal with an H level, and forcibly change the signal Gt2 into a signal with an L level.

The transistor 231*a* is, for example, a p-channel field effect transistor, the voltage $V_A$ is applied to a source terminal thereof, and a drain terminal thereof is coupled to a terminal N2 through a diode d1. The transistor 232*a* is, for example, an n-channel field effect transistor, a source terminal thereof is coupled to the ground Gnd, and a drain terminal thereof is coupled to the terminal N2 through a diode d2. The diodes d1 and d2 are used for preventing a reverse current, a forward direction of the diode d1 is a direction toward the terminal N2 from the drain terminal of the transistor 231*a*, and a forward direction of the diode d2 is a direction toward the drain terminal of the transistor 232*a* from the terminal N2.

In the same manner, the transistor 231*b* (231*c*, 231*d*) is, for example, a p-channel field effect transistor, the voltage $V_B$ ($V_C$, $V_D$) is applied to a source terminal thereof, and a drain terminal thereof is coupled to a terminal N2 through a diode d1. The transistor 232*b* (232*c*, 232*d*) is, for example, an n-channel field effect transistor, the voltage $V_A$ ($V_B$, $V_C$) is applied to a source terminal thereof, and a drain terminal thereof is coupled to the terminal N2 through a diode d2.

For example, if the transistor 231*a* is referred to as a first transistor, the transistor 232*a* is referred to as a second transistor, and the transistors 231*a* and 232*a* are referred to as a first pair of transistors, the transistor 231*b* is referred to as a third transistor, the transistor 232*b* is referred to as a fourth transistor, and the transistors 231*b* and 232*b* are referred to as a fourth pair of transistors.

In addition, detailed description will be made below, but when the level shifter 270*a* is enabled, the transistors 231*a* and 232*a* output drive signals by using the voltage $V_A$ and the ground Gnd as power supply voltages, and when the level shifter 270*b* is enabled, the transistors 231*b* and 232*b* output drive signals by using the voltage $V_A$ and the voltage $V_B$ as power supply voltages. In the same manner, when the level shifter 270*c* is enabled, the transistors 231*c* and 232*c* output drive signals by using the voltage $V_C$ and the voltage $V_B$ as power supply voltages, and when the level shifter

270*d* is enabled, the transistors 231*d* and 232*d* output drive signals by using the voltage $V_D$ and the voltage $V_C$ as power supply voltages.

In this configuration, the power supply voltage of the transistors 231*a* and 232*a*, the power supply voltage of the transistors 231*b* and 232*b*, the power supply voltage of the transistors 231*c* and 232*c*, and the power supply voltage of the transistors 231*d* and 232*d* are all 10.5 V.

If the drive circuit 120*a* is electrically coupled to the terminal N2, the drive signal COM-A is output from the terminal N2, and if the drive circuit 120*b* is electrically coupled to the terminal N2, the drive signal COM-B is output from the terminal N2.

Next, operations of the drive circuits 120*a* and 120*b* will be described by using an example in which the drive circuit 120*a* which outputs the drive signal COM-A is used.

Figure 12:
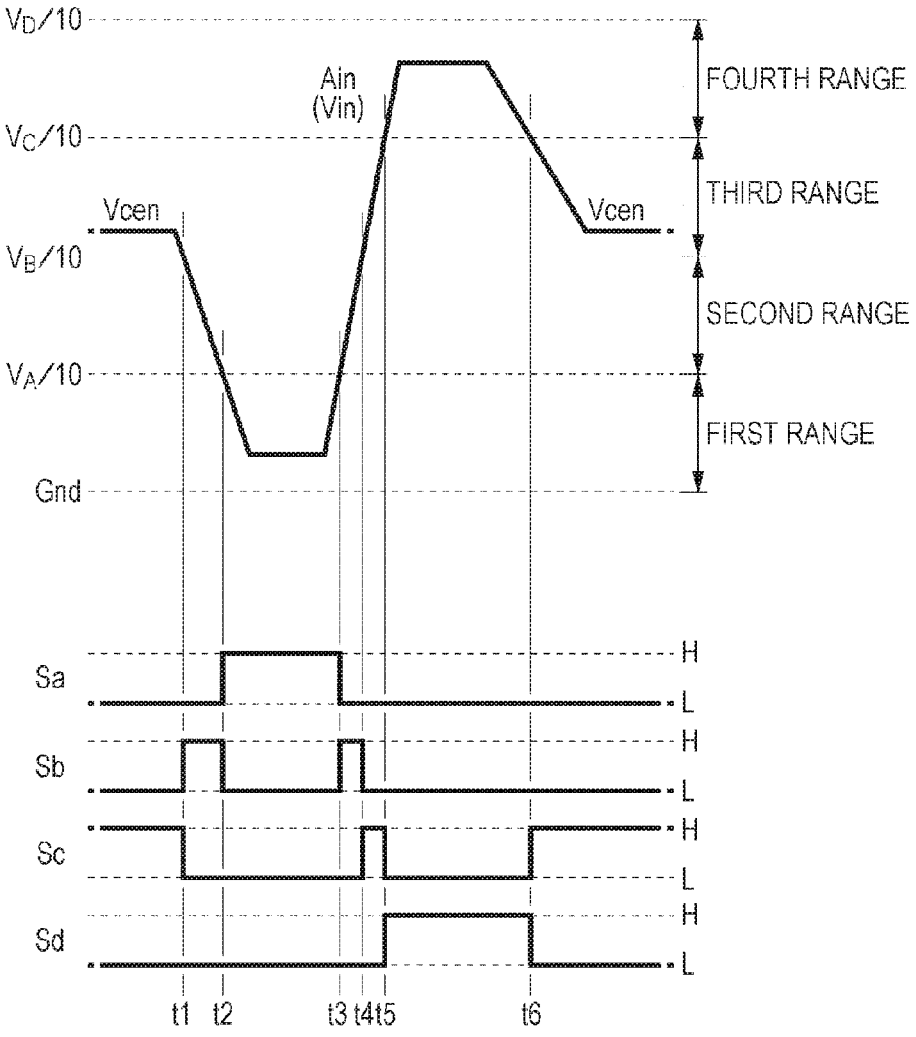
FIG. 12 is a diagram illustrating an operation of the drive circuit.

FIG. 12 is a diagram illustrating the operation of the drive circuit 120*a*.

As described above, during a print period Ta of the drive signal COM-A, two trapezoidal waveforms Adp1 and Adp2 which are the same as each other are repeated, and thus the signal Ain before voltage amplification of the drive signal COM-A has also the same waveform.

However, the signal Ain has a voltage of 1/10 of the voltage of the drive signal COM-A. For this reason, if the first range to the fourth range which are defined by the voltages $V_A$, $V_B$, $V_C$, and $V_D$ are changed to a voltage range of the signal Ain, the first range to the fourth range may be defined by voltages $V_A/10$, $V_B/10$, $V_C/10$, and $V_D/10$. That is, in the voltage Vin, voltages higher than or equal to 0 V and lower than $V_A/10$ (=1.05 V) correspond to the first range, voltages higher than or equal to $V_A/10$ and lower than $V_B/10$ (=2.10 V) correspond to the second range, voltages higher than or equal to $V_B/10$ and lower than $V_C/10$ (=3.15 V) correspond to the third range, and voltages higher than or equal to $V_C/10$ and lower than $V_D/10$ (=4.20 V) correspond to the fourth range.

FIG. 12 illustrates one trapezoidal waveform of the signal Ain, and in detail, illustrates a state in which, when viewed from the voltage Vin of the signal Ain, a voltage corresponding to, for example, the voltage Vcen is in the third range, decreases through the second range and the first range with passage of time, increases from the first range to the fourth range at once, and thereafter, decreases to a voltage corresponding to the voltage Vcen in the third range.

To begin with, if the voltage Vin is in third range and is discriminated from the data dA, the selector 280 sets only the select signal Sc to an H level, and sets the other select signals Sa, Sb, and Sc to an L level, and thereby the level shifter 270*c* is enabled, and the other level shifters 270*a*, 270*b*, and 270*d* are disabled. Hence, in this case, the transistors 231*c* and 232*c* output the drive signal COM-A, using the voltages $V_C$ and $V_B$ as power supply voltages.

Next, when the voltage Vin is in the second range during a period from timing t1 to timing t2, the selector 280 sets only the select signal Sb to an H level, and sets the other select signals Sa, Sc, and Sd to an L level, and thereby the level shifter 270*b* is enabled, and the other level shifters 270*a*, 270*c*, and 270*d* are disabled. Hence, in this case, the transistors 231*b* and 232*b* output the drive signal COM-A, using the voltages $V_B$ and $V_A$ as power supply voltages.

When the voltage Vin is in the first range during a period from timing t2 to timing t3, the selector 280 sets only the select signal Sa to an H level, and as a result, only the level shifter 270*a* is enabled, and thus the transistors 231*a* and 232*a* output the drive signal COM-A, using the voltages $V_A$ and the ground Gnd as power supply voltages.

The subsequent operations will be described in brief. Since only the level shifter 270*b* is enabled during a period from timing t3 to timing t4, the transistors 231*b* and 232*b* use the voltages $V_B$ and $V_A$ as power supply voltages. Since only the level shifter 270*c* is enabled during a period from timing t4 to timing t5, the transistors 231*c* and 232*c* use the voltages $V_C$ and $V_B$ as power supply voltages. Since only the level shifter 270*d* is enabled during a period from timing t5 to timing t6, the transistors 231*d* and 232*d* use the voltages $V_D$ and $V_C$ as power supply voltages. Since only the level shifter 270*c* is enabled from timing t6, the transistors 231*c* and 232*c* use the voltages $V_C$ and $V_B$ as power supply voltages, and respectively output the drive signal COM-A.

Next, an operation of the pairs of transistors will be described by using an example in which the transistors 231*a* and 232*a* that operate in the first range are used. In the first range, only the level shifter 270*a* is enabled.

The operation will be schematically described as follows. If the voltage Out2 of the terminal N3 is lower than the voltage ($Vin-V_1$), the signal Gt1 goes to an L level and thereby the transistor 231*a* is turned on. Accordingly, the voltage Out2 (Out) is controlled to be increased. Meanwhile, if the voltage Out2 increases to a voltage higher than or equal to the voltage ($Vin+V_2$), the signal Gt2 goes to an H level and thereby the transistor 232*a* is turned on. Accordingly, the voltage Out2 (Out) is controlled to be decreased.

Detailed description will be made with reference to FIG. 14 and FIG. 15.

Figure 13:
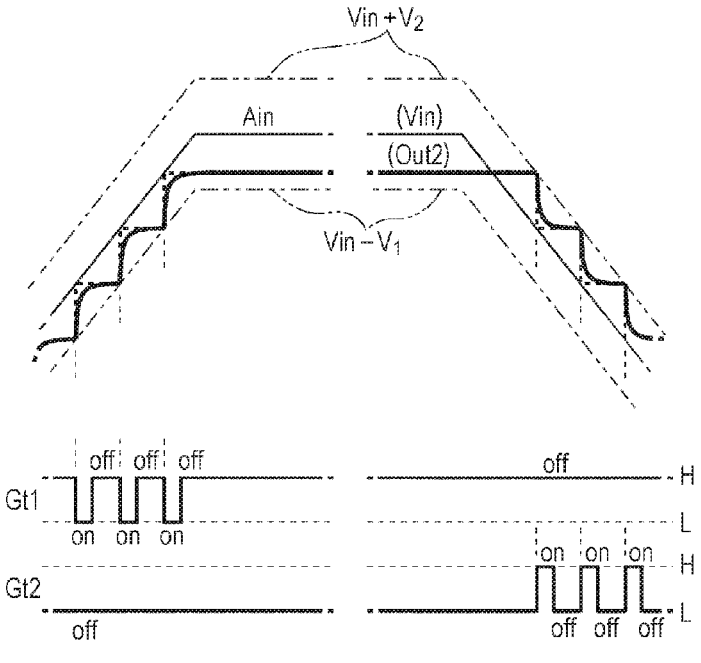
FIG. 13 is a diagram illustrating an operation of the drive circuit.
Figure 14:
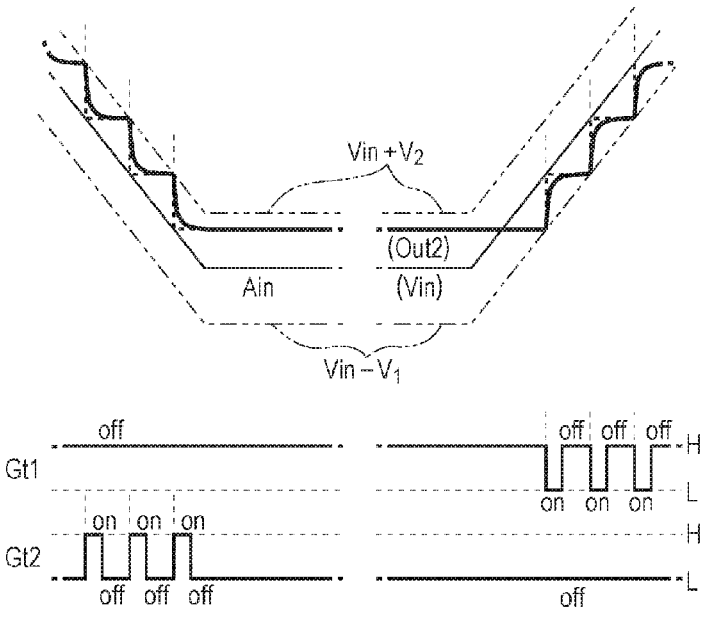
FIG. 14 is a diagram illustrating an operation of the drive circuit.

FIG. 13 and FIG. 14 illustrate changes of the voltage Out2 with respect to a change of the voltage Vin of the signal Ain. Since the signal Ain is a trapezoidal waveform, forms of a change of a voltage change rate (slope) are divided into four patterns as follows. That is, the four patterns includes:

a change from rise to flat (first pattern), a change from flat to fall (second pattern), a change from fall to flat (third pattern), a change from flat to rise (fourth pattern).

In the four patterns, it does not mean that the voltage Vin changes necessarily in that sequence.

The left column of FIG. 13 illustrates a waveform of the voltage Out2 when the voltage Vin changes in the first pattern.

If the voltage Vin rises, the voltage ($Vin-V_1$) also rise in accordance with the voltage Vin. When the voltage Out2 is lower than the increasing voltage ($Vin-V_1$) with respect to rising of the voltage Vin, the signal Gt1 goes to an L level, the transistor 231*a* is turned on, and thus the voltage Out2 rises. However, the voltage Out2 immediately rises to a voltage higher than or equal to the voltage ($Vin-V_1$), and thus the signal Gt1 goes to an H level, and the transistor 231*a* is turned off. When the voltage Vin rises, such an operation is repeated, and thus the voltage Out2 ideally changes in a stepwise shape as illustrated by a dashed line in the figure. However, when viewed from the terminal N2 toward an output side, a type of integral circuit is formed by resistance or impedance components through which the drive signal COM-A is transmitted, and the piezoelectric element Pzt or the like which is a load, and thus an actual waveform of the voltage Out becomes gentle with respect to the stepwise waveform. For this reason, the voltage Out also becomes gentle with respect to the voltage Out2.

When rising of the voltage Vin is stopped and the voltage Vin becomes flat, the voltage ($Vin-V_1$) also becomes flat, and thus the voltage Out is retained in accordance with the piezoelectric element Pzt or the like including capacitance that is a load as a value when the transistor 231*a* is finally turned off from a turn-on state. Accordingly, the voltage Out2 is also retained.

The right column of FIG. 13 is a diagram illustrating a waveform of the voltage Out2 when the voltage Vin changes in the second pattern.

If the voltage Vin changes from flat to fall, the voltage (Vin+$V_2$) also falls in accordance with the voltage Vin. If the voltage Out2 which is retained flat becomes higher than or equal to the voltage (Vin+$V_2$) which falls, the transistor 232*a* is turned on, and thus the voltage Out2 decreases, but immediately decreases to a voltage lower than the voltage (Vin+$V_2$). Accordingly, the transistor 232*a* is turned off. When the voltage Vin falls, such an operation is repeated, and thus the voltage Out2 ideally changes in a stepwise shape as illustrated by a dashed line in the figure, but actual waveform of the voltage Out2 becomes gentle by the integral circuit.

The left column of FIG. 14 is a diagram illustrating a waveform of the voltage Out2 when the voltage Vin changes in the third pattern. If the voltage Vin changes from fall to flat, the voltage (Vin+$V_2$) also becomes flat, and thus the voltage Out2 is finally retained as a value when the transistor 232*a* is turned off from a turn-on state.

The right column of FIG. 14 is a diagram illustrating a waveform of the voltage Out2 when the voltage Vin changes in the fourth pattern. If the voltage Vin changes from flat to rise, the (Vin−$V_1$) also rises in accordance with the voltage Vin. The voltage Out2 which is retained flat becomes lower than the voltage (Vin−$V_1$) which rises, with respect to the rising of the voltage Vin. The subsequent operation is the same as the operation when the voltage Vin rises in the first pattern.

Hence, if the voltage Vin is in the first range, the voltage Out2 is controlled to follow the voltage Vin, and thus, in the end, the voltage Out is controlled to be 10 times the voltage Vin.

If the voltage Vin is in the second range, the level shifter 270*b* is enabled, and thus, in the same manner, the voltage Out is controlled to be 10 times the voltage Vin in accordance with the transistors 231*b* and 232*b*.

If the voltage Vin is in the third range, the level shifter 270*c* is enabled, and thus, the voltage Out is controlled to be 10 times the voltage Vin in accordance with the transistors 231*c* and 232*c*. In addition, If the voltage Vin is in the fourth range, the level shifter 270*d* is enabled, and thus, the voltage Out is controlled to be 10 times the voltage Vin in accordance with the transistors 231*d* and 232*d*.

As described above, the description is focused on the form in which a change rate (slope) of the voltage Vin is changed, but the voltage Vin can change (transition) across a region adjacent to each other in the first range to the fourth range. For example, referring to FIG. 12, the voltage Vin is transitioned from the third range to the second range at timing t1.

If the voltage Vin is in the third range, the level shifter 270*c* is enabled, and thus the voltage Out is controlled to be 10 times the voltage Vin in accordance with the transistors 231*c* and 232*c*. When the voltage Vin is transitioned from the third range to the second range at timing t1, the level shifter 270*c* is disabled, the level shifter 270*b* is enabled, and thus the voltage Out which is continuous is controlled to be 10 times the voltage Vin in accordance with the transistors 231*b* and 232*b*.

Here, a case in which the voltage Vin is transitioned from the third range to the second range is described as an example, but the operation is also the same as in other cases. For example, if the voltage Vin is transitioned from the second range to the first range, the level shifter 270*b* is disabled, the level shifter 270*a* is enabled, and thus the voltage Out which is continuous is controlled to be 10 times the voltage Vin in accordance with the transistors 231*a* and 232*a*.

Here, the drive circuit 120*a* which outputs the drive signal COM-A is described, but the drive circuit 120*b* which outputs the drive signal COM-B performs the same operation, if it is noted that the drive signal COM-B has the trapezoidal waveform Bdp1 during a period T1 and has the trapezoidal waveform Bdp2 during a period T2.

Figure 15:
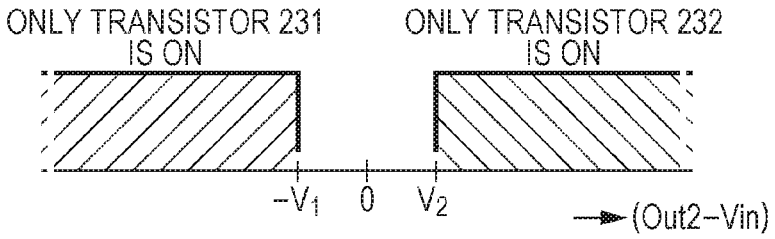
FIG. 15 is a diagram illustrating an operation of a transistor with regard to a relationship between an input signal and an output signal.

FIG. 15 is a diagram illustrating a region in which transistors 231 and 232 are turned on with regard to a change of a voltage (Out−Vin).

Here, the transistors 231 and 232 are used for general description, in a case in which the transistors 231*a* and 232*a*, the transistors 231*b* and 232*b*, the transistors 231*c* and 232*c*, or the transistors 231*d* and 232*d* are not particularly limited to a voltage range.

As illustrated in FIG. 15, if the voltage (Out2−Vin) is lower than −$V_1$, only the transistor 231 is turned on, and if the voltage (Out2−Vin) is higher than or equal to $V_2$, only the transistor 232 is turned on.

Meanwhile, if the voltage (Out2−Vin) is higher than or equal to −$V_1$ and lower than $V_2$, both the transistors 231 and 232 are turned off. For this reason, a region (dead band) exists in which the voltage Out2 (Out) does not change in the first range to the fourth range. Due to this dead band, the voltage Out2 has an error of maximum $V_1$ in a negative direction, and an error of maximum $V_2$ in a positive direction, with respect to the voltage Vin. If viewed from the voltage Out of the terminal N2, an error of 10 times a voltage change rate, that is, errors of maximum 10 $V_1$ in the negative direction, and maximum 10 $V_2$ in the positive direction, occur.

However, the error can be reduced depending on setting of the voltage $V_1$ of the reference power supply 211 and the voltage $V_2$ of the reference power supply 212. Specifically, if the voltages $V_1$ and $V_2$ are set to, for example, an error of 0.01 V, the error can be reduced to the extent that there is practically no problem with respect to the waveform of the drive signal COM-A which swings with an amplitude of approximately 40 V.

However, since the voltage Out swings with an amplitude of approximately 0 V to 40 V, if the voltage Out is controlled only by one set of a high side transistor and a low side transistor, the transistor set needs to be driven by a power supply voltage of 40 V, and thus a high breakdown voltage is necessary, and high cost or large circuit size is required.

In contrast to this, in the present embodiment, the power supply voltages for the pairs of four transistors are all set to a voltage E, that is, 10.5 V, and thus a low breakdown voltage can be used for the transistors, and it is possible to prevent cost or a circuit size from increasing.

In the present embodiment, a configuration is used in which, in order to drive any one of the four pairs of transistors, the selector 280 selects one of the enabled level shifters 270*a*, 270*b*, 270*c*, and 270*d* in accordance with the data dA (dB), and the enabled level shifter level-shifts the signals Gt1 and Gt2 to supply to the pairs of transistors.

For this reason, in the present embodiment, one set of comparison units of the comparators 221 and 222 is sufficient, compared to a configuration in which a comparison unit is provided in accordance with each of the pairs of transistors.

In addition, in the present embodiment, a circuit which oscillates a triangular waveform or the like when an input signal is modulated, or a low pass filter for demodulation is not required, and thus it is possible to simplify a circuit configuration and to reduce power consumption by that amount.

Furthermore, if a voltage of the input signal is flat, the transistors 231*a*, 231*b*, 231*b*, 231*d*, 232*a*, 232*b*, 232*c*, and 232*d* are all turned off, and thus a problem in which power is wastefully consumed by switching is not created.

In the present embodiment, if the piezoelectric element Pzt of the printing head 22 is an efficient product in accordance with rank information, the control unit 110 sets the signal DsD of the data ReA (ReB) to an H level, and controls the voltage boosting circuit 292*d* to stop a voltage boosting operation. For this reason, the voltage boosting operation of the voltage boosting circuit 292*d* is not performed with respect to the efficient product in which a maximum voltage value of the changed drive signal COM-A (COM-B) is completed at a voltage lower than 31.5 V, and thus it is possible to reduce power consumption by that amount. In the same manner, if the piezoelectric element Pzt of the printing head 22 is an excellent product in accordance with rank information, the control unit 110 sets the signals DsC and DsD to an H level, and control the voltage boosting circuit 292*c* and 292*d* to stop a voltage boosting operation. For this reason, the voltage boosting operations of the voltage boosting circuit 292*c* and 292*d* are not performed with respect to the excellent product in which a maximum voltage value of the changed drive signal COM-A (COM-B) is completed at a voltage lower than 21.0 V, and thus it is possible to more reduce power consumption by that amount.

The power supply unit 290 may be configured as follows in addition to the circuit illustrated in FIG. 11, that is, the circuit configuration which boosts a voltage by using different magnification.

Figure 17:
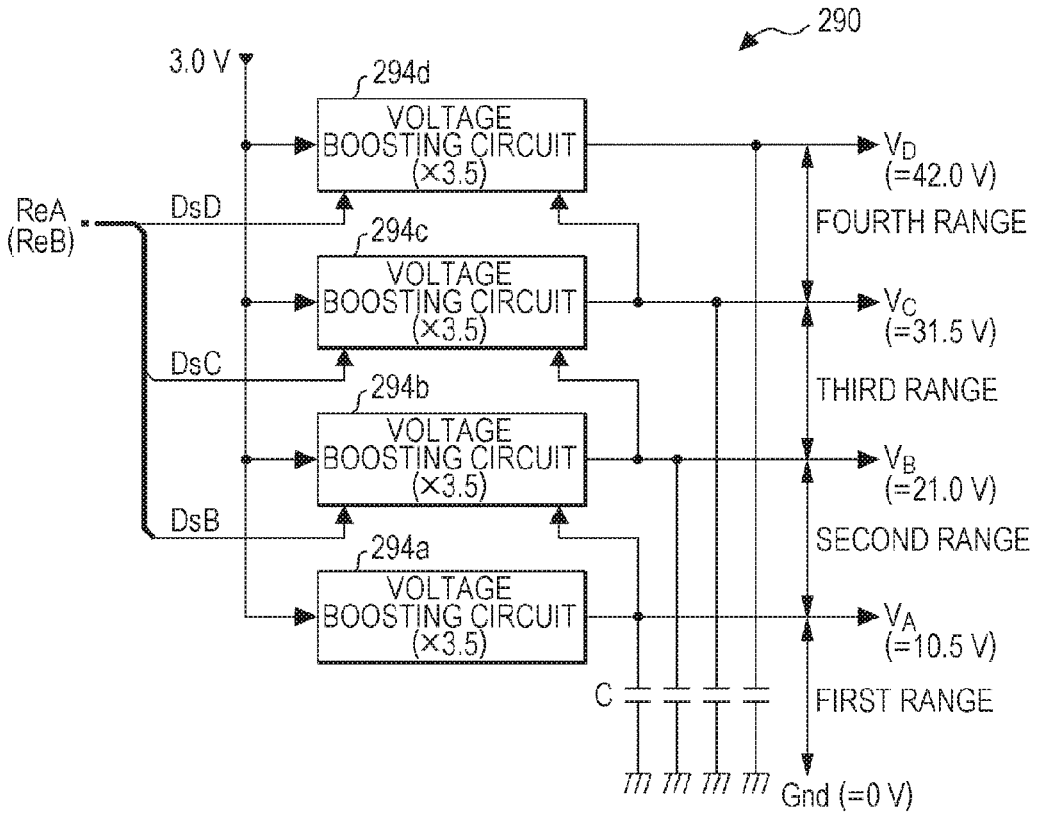
FIG. 17 is a diagram illustrating another configuration of the power supply unit.

FIG. 17 is a diagram illustrating another configuration of the power supply unit 290.

In an example of FIG. 17, voltage boosting circuits 294*a*, 294*b*, 294*c*, and 294*d* boost, for example, a single voltage of 3.0 V by 3.5 times in the same manner.

However, the voltage boosting circuit 294*b* outputs 21.0 V which is obtained by adding 10.5 V that is boosted by the voltage boosting circuit 294*b* to 10.5 V that is an output of the voltage boosting circuit 294*a*, as the voltage $V_A$. In the same manner, the voltage boosting circuit 294*c* outputs 31.5 V which is obtained by adding 10.5 V that is boosted by the voltage boosting circuit 294*c* to 21.0 V that is an output of the voltage boosting circuit 294*b*, as the voltage $V_B$. The voltage boosting circuit 294*d* outputs 42.0 V which is obtained by adding 10.5 V that is boosted by the voltage boosting circuit 294*d* to 31.5 V that is an output of the voltage boosting circuit 294*c*, as the voltage $V_D$.

The voltage boosting magnifications of the voltage boosting circuits 294*a*, 294*b*, 294*c*, and 294*d* may be the same as each other, or may be different from each other.

In addition, the signals DsA, DsB, and DsC of the data ReA (ReB) are the same as those in FIG. 11 in that the voltage boosting operation is allowed to an L level and the voltage boosting operation is stopped to an H level.

In addition, the drive circuit 120*a* (120*b*) illustrated in FIG. 10 has a configuration in which, in order to drive any one of the four pairs of transistors, the selector 280 selects one of the enabled level shifters 270*a*, 270*b*, 270*c*, and 270*d*, in accordance with the data dA (dB), and the enabled level shifter level-shifts the signals Gt1 and Gt2 to supply to the pairs of transistors, but may be configured as follows.

In detail, a configuration may be provided in which the drive voltage of a pair of transistors is supplied in accordance with data dA (dB) by selecting any one of voltage sets ($V_A$, Gnd), ($V_B$, $V_A$), ($V_C$, $V_B$), and ($V_D$, $V_C$) and using the selected voltage set as power supply voltages.

That is, in a configuration in which multiple power supply voltages for the pair of transistors are used, voltage boosting operations of unused voltages may be stopped.

In the embodiment, the transistors 231*a*, 231*b*, 231*c*, and 231*d* are set to a P-channel type, and the transistors 232*a*, 232*b*, 232*c*, and 232*d* are set to a N-channel type, but may be set to P-channel type or N-channel type.

In addition, the transistors are described as switching elements which are turned on or off, but the invention is not limited to this. For example, a configuration may be provided in which a drain current (resistance between source and drain) is changed in accordance with a voltage between a gate and a source. That is, a configuration may be provided in which the transistor 231 (232) is controlled by the signal Gt1 (Gt2).

In addition, the reference power supplies 211 and 212, the comparators 221 222, the level shifters 270*a*, 270*b*, 270*c*, and 270*d*, and the selector 280 may be integrated into a semiconductor device. In other words, the reference power supply E, the transistors 231*a*, 231*b*, 231*c*, 231*d*, 232*a*, 232*b*, 232*c*, and 232*d* (including diodes d1 and d2 for preventing reverse current) may be configured by external components.

In the embodiment, the voltage Vin is offset by the reference power supply 211 by the voltage $V_1$, and is offset by the reference power supply 212 by the voltage $V_2$, but since two voltages which are obtained by offsetting the voltage Vin (or the voltage Out as illustrated below) in vertical direction may be able to obtain, a configuration for the offset is not limited to elements such as a power supply (battery). For example, multiple combinations of the elements such as diodes or resistors may be used as follows.

Figure 16:
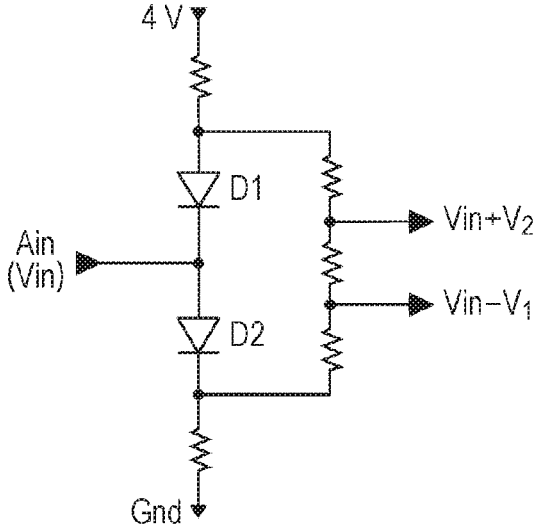
FIG. 16 is a diagram illustrating another example of a first offset unit and a second offset unit.

FIG. 16 is a diagram illustrating a configuration example (another example of a first offset unit and a second offset unit) for obtaining the voltages ($Vin+V_2$) and ($Vin-V_1$) which are obtained by offsetting the voltage Vin in a vertical direction.

In this example, the voltages ($Vin-V_1$) and ($Vin+V_2$) can be obtained by resistance-dividing voltages from a voltage which is obtained by offsetting the voltage Vin in a high side by a forward voltage of the diode D1, to a voltage which is obtained by offsetting the voltage Vin in a low side by a forward voltage of the diode D2.

In addition, the drive circuit 120*a* (120*b*) according to the embodiment has a configuration in which the comparator 221 discriminates whether the voltage Out2 is higher than or equal to the voltage ($Vin-V_1$) or lower than the voltage ($Vin-V_1$).

That is, a configuration is used in which the comparator 221 discriminates whether $Out2 \geq Vin-V_1$ or $Out2 < Vin-V_1$.

Here, the inequality can be changed to $Out2+V_1 \geq Vin$ or $Out2+V_1 < Vin$, and thus the comparator 221 may discriminate whether the voltage ($Out2+V_1$) is higher than or equal to the voltage Vin or lower than the voltage Vin.

In addition, the inequality can also be changed to $Out+V_1/2 \geq Vin-V_1/2$, or $Out+V_1/2 < Vin-V_1/2$. For this reason, the comparator 221 may discriminate whether the voltage ($Out2+V_1/2$) is higher than or equal to the voltage ($Vin-V_1/2$) or lower than the voltage ($Vin-V_1/2$).

The point is that a configuration may be provided in which the comparator 221 offsets at least one of the voltage Vin that is an input signal and the voltage Out2 based on the drive signal of an output, and compares voltages in which the one is relatively offset to the other by the voltage $V_1$.

In the same manner, a configuration is used in which the comparator 222 discriminates whether Out2≥Vin+$V_2$ or Out2<Vin+$V_2$.

Here, the inequality can be changed to Out2−$V_2$≥Vin or Out2−$V_2$<Vin, and thus the comparator 222 may discriminate whether the voltage (Out2−$V_2$) is higher than or equal to the voltage Vin or lower than the voltage Vin.

In addition, the inequality can also be changed to Out2−$V_2$/2≥Vin+$V_2$/2, or Out2−$V_2$/2<Vin+$V_2$/2. For this reason, the comparator 222 may discriminate whether the voltage (Out2−$V_2$/2) is higher than or equal to the voltage (Vin+$V_2$/2) or lower than the voltage (Vin+$V_2$/2).

The point is that a configuration may be provided in which the comparator 222 offsets at least one of the voltage Vin that is an input signal and the voltage Out2 based on the drive signal of an output, and compares voltages in which the one is relatively offset to the other by the voltage $V_2$.

In the embodiment, a configuration is used in which the selector 280 of the drive circuit 120*a* (120*b*) discriminates whether or not the voltage Vin is included in any one of the first range to the fourth range in accordance with the data dA (dB), but the signal Ain (Bin) which is an output signal of the DAC 113*a* (113*b*) may be used to discriminate even though slightly low accuracy and delay occurs.

For this reason, "in accordance with the voltage Vin (in accordance with input signal)" is synonymous to that discriminations are respectively made (the pair of transistors is selected) in accordance with the data dA (dB) and in accordance with a signal which is obtained by converting the data dA (dB) into an analog signal.

In addition, discrimination may be made by weighting two signals of the signals Ain (Bin) which are obtained by converting data dA (dB) and the data dA (dB) into analog data, for combination.

In the embodiment, the level shifters in the drive circuit 120*a* (120*b*), and the sets of the pairs of transistors are respectively set to "4", but may be set to "2". The more the number of sets is, the lower the power supply voltage is, and thus a transistor with a lower breakdown voltage can be used.

In addition, in the embodiment, a configuration is used in which the voltages $V_A$, $V_B$, $V_C$, and $V_D$ are output from a reference power supply which outputs the voltage E and are coupled in four-stage-series (refer to FIG. 11), and thus a difference between a high side voltage and a low side voltage of each voltage set is set to the voltage E (=10.5 V), but may be configured to be not set.

In addition, the voltage range may partially overlap in a region adjacent to each other among the first range to the fourth range. For example, the first range is set to voltages higher than or equal to zero volts and lower than a voltage ($V_A$+α), the second range is set to voltages higher than or equal to a voltage ($V_A$−α) and lower than a voltage ($V_B$+α), the third range is set to voltages higher than or equal to a voltage ($V_B$−α) and lower than a voltage ($V_C$+α), the fourth range is set to voltages higher than or equal to a voltage ($V_C$−α) and lower than the voltage $V_B$, and the voltages may respectively overlap each other by ±α around the voltages $V_A$, $V_B$, and $V_C$.

In addition, in the embodiment, a liquid ejecting apparatus is described as a printing apparatus, but the liquid ejecting apparatus may be a three-dimensional shaping apparatus which shapes a three-dimensional image by ejecting liquid, a textile dyeing apparatus which dyes textile by ejecting liquid, or the like.

In addition, in the embodiment, an example in which the piezoelectric element Pzt which ejects ink is used as a drive target of the drive circuit 120*a* (120*b*) is described, but when it is considered that the drive circuit 120*a* is separated from the printing apparatus, the drive target is not limited to the piezoelectric element Pzt, and can be applied to, for example, an ultrasonic motor, a touch panel, an electrostatic speaker, or all of the load having a capacitive component such as a liquid crystal panel.

What is claimed is:

1. A drive circuit for driving a capacitive load, comprising:

a power supply unit that includes multiple voltage outputting circuits which output power supply voltages different from each other, wherein a drive circuit amplifies an original drive signal based on a power supply voltage which is generated by at least one of the multiple voltage outputting circuits and generates a drive signal which is applied to the capacitive load, and wherein the power supply unit controls the voltage outputting circuit, which generates the power supply voltage that is not used for amplification, to stop voltage outputting.

2. The drive circuit for driving a capacitive load, according to claim 1, wherein the multiple voltage outputting circuits is multiple voltage boosting circuits which boost a voltage each other.

3. The drive circuit for driving a capacitive load, according to claim 2, wherein voltage boosting magnifications of the multiple voltage boosting circuits are different from each other.

4. The drive circuit for driving a capacitive load, according to claim 1, wherein the multiple voltage outputting circuits include a first voltage outputting circuit that generates a first voltage, and a second voltage outputting circuit that generates a second voltage, and wherein the second voltage outputting circuit generates an addition voltage which is obtained by summing a value of the first voltage and a value of the second voltage, and supplies the addition voltage to the drive circuit.

* * * * *